US010582814B2

(12) United States Patent
Larsson et al.

(10) Patent No.: US 10,582,814 B2
(45) Date of Patent: Mar. 10, 2020

(54) DISPENSER FOR INTERFOLDED NAPKINS

(71) Applicant: SCA Hygiene Products AB, Göteborg (SE)

(72) Inventors: Björn Larsson, Göteborg (SE); Jan Lundgren, Malmö (SE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 0 days.

(21) Appl. No.: 15/501,237

(22) PCT Filed: Aug. 29, 2014

(86) PCT No.: PCT/EP2014/068394
§ 371 (c)(1),
(2) Date: Feb. 2, 2017

(87) PCT Pub. No.: WO2016/029964
PCT Pub. Date: Mar. 3, 2016

(65) Prior Publication Data

US 2017/0231438 A1 Aug. 17, 2017

(51) Int. Cl.
*A47K 10/42* (2006.01)
*A47K 10/32* (2006.01)

(52) U.S. Cl.
CPC ..... *A47K 10/422* (2013.01); *A47K 10/423* (2013.01); *A47K 2010/3233* (2013.01); *A47K 2010/3266* (2013.01)

(58) Field of Classification Search
CPC .... A47K 10/44; A47K 10/422; A47K 10/423; A47K 2010/3233; A47K 2010/3266; B65D 83/0817; B65D 83/0858
See application file for complete search history.

(56) References Cited

U.S. PATENT DOCUMENTS 1,603,714 A * 10/1926 Rappleye ..... A47K 10/44 221/48
1,913,363 A * 6/1933 Allen ..... A47K 10/22 242/596.4

(Continued)

FOREIGN PATENT DOCUMENTS

CN 102006809 A 4/2011
CN 102395306 A 3/2012

(Continued)

OTHER PUBLICATIONS

Chinese Office Action dated Oct. 26, 2018 issued in corresponding Chinese patent application No. 201480081534.X (9 pages) and its English-language translation thereof (9 pages).

(Continued)

*Primary Examiner* — Gene O Crawford
*Assistant Examiner* — Kelvin L Randall, Jr.
(74) *Attorney, Agent, or Firm* — Drinker Biddle & Reath LLP

(57) ABSTRACT

A dispenser for interfolded napkins includes a container having a supporting surface for supporting a stack of interfolded napkins. The supporting surface extends in a horizontal plane, and is surrounded by side walls extending in a vertical direction perpendicular to the supporting surface. The side walls define a dispensing opening opposite the supporting surface. At least one tab is arranged in the container for retaining the stack of napkins during withdrawal of a napkin from the stack. The tab is pivotably arranged in relation to the container between a holding position, in which the tab extends horizontally over at least a portion of the dispensing opening, and a refill position, in which the tab is directed away from the dispensing opening. The tab pivots about a living hinge. One or more stop (Continued)

surfaces limit an extent to which the tab is able to turn about the living hinge toward the dispensing mouth.

26 Claims, 9 Drawing Sheets

(56) References Cited

U.S. PATENT DOCUMENTS 2,095,419 A * 10/1937 Pollard ..... A47K 10/22 242/596.3
2,253,742 A * 8/1941 West ..... A47K 10/422 221/52
2,643,069 A * 6/1953 Carlin ..... A47K 10/22 242/596.4
2,806,529 A * 9/1957 Bulman ..... B65H 35/002 225/52
2,849,153 A * 8/1958 Tuttle ..... A47K 10/422 221/154
2,942,795 A * 6/1960 McCreary ..... A47K 10/38 242/596.4
3,840,146 A * 10/1974 Bodek ..... A47K 10/422 221/244
4,043,519 A * 8/1977 Suzuki ..... A47K 10/38 242/596.4
4,311,252 A 1/1982 Hope, Jr. et al.
4,452,403 A * 6/1984 Arronte ..... A47K 10/40 242/596.4
4,553,710 A * 11/1985 Pool ..... A47K 10/40 242/596.4
4,614,312 A * 9/1986 Del Pino ..... A47K 10/40 242/596.4
4,974,783 A * 12/1990 Campbell ..... A47K 10/40 242/160.1
5,642,836 A * 7/1997 Merriweather, Jr. ..... A47K 10/424 221/281
5,868,347 A * 2/1999 Paul ..... A47K 10/40 242/596.4
5,957,324 A * 9/1999 Gettelman ..... A47K 10/424 221/312 R
6,189,828 B1 * 2/2001 Reilly ..... A47K 10/40 242/596.4
6,267,323 B1 * 7/2001 Phelps ..... A47K 10/3827 242/588.3
6,286,781 B1 * 9/2001 Lai ..... A47K 10/40 242/596.4
6,386,478 B2 * 5/2002 Reilly ..... A47K 10/40 242/596.4
6,409,120 B1 * 6/2002 Tramontina ..... A47K 10/38 242/594.5
6,502,781 B1 * 1/2003 Tramontina ..... A47K 10/40 242/423.2
6,666,364 B2 * 12/2003 Phelps ..... A47K 10/40 225/106
6,779,683 B2 * 8/2004 Taylor ..... A47K 10/424 221/47
6,848,349 B2 * 2/2005 Tramontina ..... A47K 10/38 225/72
6,959,635 B2 * 11/2005 Tramontina ..... A47K 10/38 225/20
7,178,689 B2 * 2/2007 Wieser ..... A47K 10/422 221/45
8,136,697 B2 * 3/2012 Hackney ..... A47F 1/08 221/303
8,616,491 B2 * 12/2013 Smith ..... A47K 10/40 242/596.4
10,028,627 B2 * 7/2018 Boeltl ..... A47K 10/40
10,188,244 B2 * 1/2019 Larsson ..... A47K 10/34
10,314,444 B2 * 6/2019 Boeltl ..... A47K 10/40
2003/0019880 A1 * 1/2003 Timmers ..... A47K 10/427 221/47
2003/0146339 A1 * 8/2003 Liu ..... B65H 16/005 242/596.4
2003/0189059 A1 10/2003 May et al.
2003/0201274 A1 * 10/2003 Taylor ..... A47K 10/424 221/61
2003/0221986 A1 * 12/2003 Reinke ..... A47K 10/421 206/494
2004/0016714 A1 1/2004 Wood et al.
2004/0084471 A1 5/2004 Taylor et al.
2006/0163418 A1 * 7/2006 Ko ..... A47K 10/40 242/596.4
2006/0273102 A1 12/2006 Wieser et al.
2009/0272756 A1 * 11/2009 Hackney ..... A47F 1/08 221/154
2011/0011876 A1 * 1/2011 Baer ..... B65D 83/0805 221/1
2011/0011878 A1 1/2011 Baer et al.
2011/0042405 A1 2/2011 Martin Machota et al.
2012/0032565 A1 2/2012 Stoop et al.
2013/0213995 A1 * 8/2013 Horel ..... A47K 10/424 221/197

FOREIGN PATENT DOCUMENTS

DE 8911997 U1 11/1989
RU 2 283 805 C2 9/2006
WO WO-2005/034702 A1 4/2005
WO WO-2013/064165 A2 5/2013
WO WO-2014/037041 A1 3/2014

OTHER PUBLICATIONS

Russian Office Action dated Mar. 26, 2018 issued in corresponding Russia patent application No. 2017110097 (8 pages) and its English-language translation thereof (8 pages).
Office Action dated Apr. 25, 2018 issued in corresponding Canadian patent application No. 2,959,211.
Colombian Office Action Oficio N° 5539 dated Jun. 6, 2018 issued in corresponding Colombian patent application No. NC2017/0002379 (10 pages) and its partial English-language translation thereof (9 pages).
Russian Decision to Grant dated Aug. 20, 2018 issued in corresponding Russian patent application No. 2017110097 (11 pages) and its English-language translation thereof (7 pages).
Second Chinese Office Action dated May 17, 2019 issued in corresponding Chinese patent application No. 201480081534.X (7 pages) and its English-language translation thereof (10 pages).

* cited by examiner

DISPENSER FOR INTERFOLDED NAPKINS

CROSS-REFERENCE TO PRIOR APPLICATION

This application is a § 371 National Stage Application of PCT International Application No. PCT/EP2014/068394 filed Aug. 29, 2014, which is incorporated herein in its entirety.

TECHNICAL FIELD

The present disclosure relates to a dispenser for sheet products (e.g. interfolded napkins), the dispenser including a housing and a supporting surface for supporting a stack of sheet products, the supporting surface extending in a horizontal plane. The supporting surface is surrounded by side walls of the housing extending in a vertical direction perpendicular to the supporting surface, and defining an entrance opening opposite the supporting surface. The dispenser further includes at least one tab arranged in the housing for retaining the stack during withdrawal of a sheet product from the stack.

BACKGROUND

Napkins in the form of sheets of material intended for wiping and for hygienic purposes are common commercial items (e.g. in restaurants or cafeterias) that may be provided in the form of stacks of napkins from which individual napkins can be readily removed when needed. The dispenser for the napkins should be easy to handle, should protect the napkins until use and should be easy to move to a location where the napkins are needed, such as to a table, a counter, etc.

A common type of dispenser for this kind of napkins is an open box in which the napkins are arranged in a stack standing on an edge of the napkins with part of the napkins protruding through the opening in the box to provide grippability. This is a simple and inexpensive way of dispensing the napkins. However, the protruding parts of the napkins tend to fold over the edge of the box and become ruffled and deformed.

Moreover, as soon as a few napkins have been removed from the box, the remaining stack does not fill the width of the container with the result that the stack may buckle inside the box A further commonly used option is to arrange the napkins in an interfolded stack which is placed standing on a bottom surface in a container having a dispensing opening at the top of the container. The napkins are then successively removed from the top of the stack through the dispensing opening.

Interfolded napkins are sheets of materials arranged in a stack of superposed sheets which are each folded at least once. The sheets are interlinked in such a way that the separate folded sheets of material form a chain of sheets where each sheet has a leading panel and a trailing panel, the trailing panel being at least partly overlapped with the leading panel of the subsequent sheet in the stack. In this manner, the individual sheets are held loosely together by means of frictional forces arising between the overlapping parts. The sheets may be dispensed from a dispenser by pulling at the leading panel of the first sheet in the stack. In this manner, the first material sheet is extracted at the same time as a predetermined part of the leading panel of a subsequent material sheet is fed into a dispensing position in the dispenser.

The dispenser usually has a lid or cover with a dispensing mouth that restricts the width of the dispensed napkin in order to keep the leading panel of the next napkin to be dispensed from falling back into the dispenser.

When a napkin is extracted, due to the friction between napkins, several napkins might tend to follow the extracted one such that the user is presented with a number of napkins hanging together, rather than with a single napkin. Also, even if the subsequent napkins do not follow the first napkin to the user, the friction between the napkins might result in the stack including the napkins becoming disordered or crumpled inside the dispenser. This in turn might hinder continued extraction of napkins from the dispenser.

To maintain the stack of napkins inside the dispenser during withdrawal of a top napkin from the stack, it is known to use holding means of various kinds. Generally, such holding means or tabs may include various kinds of holding members, extending at least partly over the stack of napkins received in the container. Accordingly, the holding members will extend at least partly over any dispensing opening allowing access to the stack of napkins from a top side thereof.

It is desired to provide an improved or alternative dispenser for dispensing interfolded napkins.

WO 2014/037041 A1 discloses a napkin dispenser including tabs for holding a top of a stack of napkins in a position spaced from an inside of a dispensing face of the dispenser. The tabs are required to meet the somewhat conflicting requirements of being flexible enough to be able to be bent downwardly to allow a stack of napkins to pass during loading, yet also stiff enough to resist being bent upwardly under bias of a spring lest engagement with the top of the stack should fail. Further, the present inventors have found, these flexible tabs tend to angle and curl downwardly in the loading configuration, which causes them to rub against the stack of napkins as it is being loaded.

It is further desired to provide a dispenser with such hold back means and having improved control of a stack loading configuration of the stack hold back means. It is further desired to allow the flexibility of the hold back means, such as thickness and material parameters, to be designed more freely. Also, it is desired to ensure ease of disposition into the loading configuration, yet also make sure of an effective stack engaging configuration.

SUMMARY

In a first aspect, a dispenser includes a housing at least partly defining an interior volume for holding a stack of sheet products, the housing including a dispensing mouth through which sheet products are able to be dispensed from the dispenser, and one or more stack holdback members, wherein the stack holdback members each include a stack engaging part and a hinge, wherein the stack engaging part of each of the holdback members is able to turn about the hinge from a stack engaging orientation to a stack loading orientation, wherein when the stack engaging parts of the holdback members are in the stack engaging orientation, the stack engaging parts of the holdback members are arranged for engaging the front of the stack to space the front of the stack rearwardly from the dispensing opening, and when stack engaging parts of the holdback members are in the stack loading orientation, the stack engaging parts are arranged for providing clearance as compared to when the stack engaging parts are in the stack engaging orientation, the clearance allowing a stack to pass into the interior volume defined by the housing for loading the dispenser, wherein the hinge of each of the holdback members is a flexible hinge.

In a second aspect, a dispenser includes a housing at least partly defining an interior volume for holding a stack of sheet products, the housing including a dispensing mouth through which sheet products are able to be dispensed from the dispenser, and one or more stack holdback members, wherein the stack hold back members each include a stack engaging part and a hinge, wherein the stack engaging part of each of the holdback members is able to turn in a first direction about the hinge from a stack engaging orientation to a stack loading orientation, wherein when the stack engaging parts of the holdback members are in the stack engaging orientation, the stack engaging parts of the holdback members are arranged for engaging a front of the stack to space the front of the stack rearwardly from the dispensing mouth and wherein when the stack engaging parts of the holdback members are in the stack loading orientation, the stack engaging parts of the holdback members are arranged for providing clearance, as compared to when the stack engaging parts of the holdback members are in the stack engaging orientation, to allow a stack to pass into the interior volume defined by the housing for loading the dispenser, the dispenser including one or more stop surfaces for limiting turning of each stack engaging part of the holdback members about the hinge in a second direction opposed to the first direction to a limit orientation, wherein when the stack engaging parts of the stack holdback members are in the limit orientation, the stack engaging parts are arranged to engage the front of the stack to hold the front of the stack spaced rearwardly from the dispensing mouth.

The first and second aspects are combinable. That is, the hinge of the second aspect may be a living hinge and the dispenser of the first aspect may include the one or more stop surfaces of the second aspect.

The flexible hinges provide for localisation of the turn or rotation of the holdback members along a hinge line or axis, allowing design flexibility for other parts of the holdback members. For example, the stack engaging part can be made relatively rigid so that turning of the stack engaging part is confined to the hinge, allowing improved control of the transition from the stack engaging orientation to the stack loading orientation.

The flexible hinges are able to move between orientations with little force required, making it easy to load a fresh bundle or stack of sheet products. The hinges are oriented in the stack engaging orientation so as to contact a bottom face of a stack during loading. Continued passage of the stack into the interior volume will move the holdback members into the stack loading orientation with little return force to be overcome, by rotation about the flexible hinges. Thus, it requires less force to load the dispenser and also rubbing between the holdback members and the stack is reduced to avoid damage of the sides of the stack during loading.

The flexible hinge allows turning about the hinge as a result of flexibility (relatively increased flexibility compared to neighbouring regions) of material along a hinge axis or line.

The flexible hinges each have a localised area of increased flexibility extending along a hinge axis to provide a narrow hinge region about which the stack engaging part is prone to rotate. Thus, the hinge provides a defined hinge axis, defined by localised increased flexibility.

The stop surfaces provide for surety of stack engagement even when a bias is applied in a direction toward the dispensing mouth.

The flexible hinges may be provided by thinning the holdback member along a hinge line. The flexible hinges may additionally or alternatively be formed by orienting polymeric chains transverse to a hinge line or axis of the flexible hinge. The flexible hinges may additionally or alternatively be formed by bending (one or more times) the holdback members during manufacturing about a hinge line before material making the flexible hinges has set. The flexible hinges may additionally or alternatively be formed by shaping the holdback members to have a folding prone part located along a hinge line. The shaping may include a kink or groove that extends along the hinge line. Additionally or alternatively, the flexible hinges may be made by making the holdback members of different materials, with an inherently more flexible material forming the flexible hinge and an inherently more rigid material forming at least a surrounding part of the hinge. For example, the stack engaging part may be made of a relatively rigid material and the hinge may be made of a relatively flexible material. This may be manufactured by a double injection moulding process. The rigid parts could be made of acrylonitrile butadiene styrene (ABS), and the hinge could be made of thermoplastic polyurethane elastomer (TPE).

The stack engaging part and the hinge may be integral components. The integral components may be moulded components, such as injection moulded components.

The holdback members may be made of a polymeric material selected so as not to deform underweight or bias of the stack in the dispensing direction and yet sufficiently able to flex to ease loading. The flexible hinge assists greatly in meeting these somewhat conflicting requirements.

The holdback members may include a bridge portion extending in a direction transverse to a hinge axis or line and the stack engaging part connected by the hinge. The bridge portion, the hinge and the stack engaging part may be integrally formed, e.g. moulded such as injection moulded. The hinge may be a thinned portion relative to the bridge portion and the stack engaging part to form the hinge line. Thus, a living hinge is utilized as the hinge.

The flexible hinges may be living hinges. A living hinge is characterised at least by being formed from locally thinned material along a hinge line. Typically, such hinges also include aggregately oriented polymer chains extending transverse to the hinge axis or the hinge line. Also, such hinges are bent plural times in the intended use way just after moulding and before material forming the hinge is fully set.

The hinges may each connect a housing part and a stack engaging part. The stack engaging part is able to turn relative to the housing part about the hinge. The hinge may include one or more gaps located along the hinge line at which the stack engaging part and the housing part are unconnected. This may improve flexibility of the hinge, e.g. without having to form the hinge overly thin. The gaps may extend along the hinge axis.

The gaps may be centrally located along the hinge line or located at outermost ends of the hinge line. During injection moulding or other manufacturing processes, it can be difficult to fill very thin areas such as a living hinge. An optimal hinge would be very thin, e.g. of the order of 0.5 mm, but manufacturing processes may limit the thickness of the hinge to a thickness greater than optimal, such as 1.0 to 1.5 mm. The use of one or more open areas or gaps along the hinge line allows the desired flexibility to be achieved even at practical hinge thicknesses.

The housing part of each of the holdback members may include a sidewall portion extending perpendicularly or substantially perpendicularly (or at least have a greater perpendicular component than parallel component) relative to the stack engaging part when the stack engaging part is in the stack engaging orientation. The stack engaging part may extend parallel or substantially parallel (or at least have a greater parallel component than perpendicular component when in the stack engaging orientation) to the sidewall portion of each of the holdback members when in the stack loading orientation. The housing part may each include means for mounting the holdback members to the housing. The means for mounting may be fastener receiving openings. Alternatively, the means for mounting may be one or more resilient or snap fit fasteners. Alternatively, the side wall part of the housing part may be integral with the housing, e.g. a sidewall of the housing.

The housing part is to be fixed relative to the housing, whether by way of some mounting means such that the holdback members are separate components to the housing or by way of being formed as an integral part of the housing. The housing part may be removably fixed to the housing such as by way of snap fit fastening.

The holdback members may each include a bridge portion for spacing the hinge in a direction perpendicular to a sidewall of the housing to provide for clearance for the stack engaging part to turn about the hinge into the stack loading orientation. The direction perpendicular to the side wall of the housing is also a direction transverse to the hinge axis. In this way, the stack engaging part can collapse to be parallel or beyond parallel (relative to a direction of turning from the stack engaging orientation to the stack loading orientation) to the side wall by turning about the hinge spaced from the sidewall.

The bridge portion may be part of the above described housing part and connect the sidewall portion to the hinge.

The housing part, the stack engaging part and the hinge may be integrally formed, e.g. by moulding such as injection moulding.

The hinges may be defined at least in part by a groove extending therealong to increase flexibility of the holdback members therealong to provide for turning about a hinge axis.

The hinge may be such that the stack engaging part is able to turn or rotate in a first sense or direction (e.g. clockwise or anticlockwise) and in an opposite second sense or direction thereabout. Turning in the first sense or direction allows the stack engaging part to change orientation from the stack engaging orientation to the stack loading orientation, whereas turning in the second sense or direction is to be resisted in order to hold the front of the stack rearwardly spaced from the dispensing mouth. The stop surfaces function to prevent turning of the stack engaging part about the hinge in the second direction to any significant degree. The second direction is toward the dispensing mouth from the interior volume, i.e. in the direction in which sheet products are dispensed or the frontward direction. The first direction is a rearward direction along which the stack is moved in order to refill the interior volume with a stack of napkins from a front of the dispenser (wherein the dispensing mouth is located at the front of the dispenser).

The holdback members may each include one or more abutment surfaces and be configured so that as the stack engaging part turns about the hinge in the second direction, the abutment surfaces are caused to contact the stop surfaces to prevent further rotation of the stack engaging part in the second direction. It may be that the abutment surfaces and the stop surfaces are marginally spaced to allow for some rotation of the stack engaging part in the second direction when the stack engaging part is in the stack engaging orientation, but not enough to orient the stack engaging part out of an orientation in which the front of the stack is engaged and held back from the dispensing mouth.

The one or more stop surfaces may be arranged to contact a surface of the stack engaging part of each of the holdback members such that the one or more abutment surfaces are provided by the stack engaging part itself. The abutment surface of the stack engaging part may be a front facing side of the stack engaging part.

The one or more stop surfaces may be formed by one or more overhangs for contacting the stack engaging part of each of the holdback members. The overhang has a smaller projection from a sidewall of the housing than the stack engaging part so as to define a limited interference with the stack during loading of the stack into the interior volume when the stack engaging part is in the stack loading orientation. The overhang defines a curved surface or angled surface (angle toward the second direction or in a direction away from the dispensing mouth) to soften an interface with the stack during loading, i.e. reduce rubbing. The overhangs each extend past the hinge from the sidewall to be positioned for contacting the stack engaging part.

The stop surfaces, the hinge and the stack engaging part may be integrally formed. The stop surfaces, including any overhangs, the abutment surfaces, the stack engaging part and the hinge may be integrally formed, such as by moulding especially injection moulding. Alternatively, the stop surfaces may be formed as part of a sidewall of the housing defining the interior volume and the holdback members may be separately formed.

The dispenser may include a biasing means for biasing the stack toward the dispensing mouth, i.e. in the second direction. The biasing means may be a spring. The holdback members are arranged to maintain the stack engaging configuration to hold the stack spaced from the dispensing mouth against the bias of the biasing means. In an alternative, the bias is provided by the weight of the stack under gravity. The biasing means and the holdback members are arranged so that the stack is compressed therebetween along a dispensing or z axis and the top of the stack is spaced rearwardly from the dispensing mouth along the dispensing or z axis by way of the position along the dispensing or z axis of the holdback members.

The dispenser may include a platform arranged in the housing that is moveable in a forward and rearward direction. The platform is arranged to provide a stack support surface upon which a rear of the stack is supported. The biasing means may be arranged to act on the platform to bias it toward the dispensing mouth.

The interior volume defined by the housing may be defined by one or more sidewalls of the housing. The sidewalls may be arranged to define a square or rectangular x-y axis cross-section that extends along a z-axis to define the interior, stack receiving and holding, volume. The first and second directions defined above are aligned along the z-axis. The z-axis may be curved or straight.

That is, a z-axis passes through a centre of the interior volume in a front to rear direction aligned with a direction of loading a stack and dispensing sheet products. The z-axis may be curved or straight depending on shape of housing and interior volume defined thereby. Dispensers often define a cuboid interior volume, but dispensers are also known to hold the stack along a curved interior volume.

The holdback members may be arranged to be caused to move from the stack engaging orientation to the stack loading orientation by the stack passing from outside of the housing into the interior volume housing along a first direction, engaging the holdback members along the way when they are in the stack engaging orientation and causing them to be turned about the hinge along the first direction.

The holdback members are arranged so as to be biased into the stack engaging orientation such that in the absence of external forces, the holdback members will each assume the stack engaging orientation and will spring thereto from the stack loading orientation.

The holdback members serve to space the front of the stack from the dispensing mouth. The dispenser includes a front member into which the dispensing mouth is defined. The front member (or dispensing face) defines an interior surface partly defining the interior volume. The holdback members serve to space the front of the stack from the interior surface of the front member. The space may be at least 0.5 cm and may be up to 10 cm in a direction along an axis (the above z-axis) passing through a centre of the stack and out of the dispensing mouth. Smaller spacing allows for greater use of capacity of the dispenser, while larger spacing can improve dispensing smoothness.

The holdback members space the front of the stack rearwardly from the dispensing mouth such that a foremost sheet product in the stack is required to extend from a level of the holdback members through the space and out of the dispensing mouth to be positioned for grasping by a user for dispensing. A majority of the foremost sheet product is free from contact with the dispenser in the space, thereby significantly reducing friction during dispensing.

The total area of the stack engaging part that engages the front of the stack is small (e.g. less than 30%) as compared to the total area of the front of the stack or the total area of the front of the largest stack that could fit in the interior volume. That is, the stack engaging parts are smaller in area (e.g. less than 30%) than an area of an interior surface of a dispensing face of the dispenser including the dispensing mouth. This reduced area of contact as well as the spacing from the dispending mouth provided by the holdback members provides improved dispensing feel.

In an embodiment, the stack engaging parts may include a friction enhancing surface to improve grip on the front of the stack.

A stack of sheet products typically has a front end face, a rear end face and sidewalls extending therebetween. The sidewalls include opposed folds sidewalls, formed by folded sides of the stack when the stack is made up of interfolded sheet products, and opposed edges sidewalls that are formed by free edges of sheet products rather than folds. The one or more stack holdback members may include plural stack holdback members that are arranged in opposition to engage on opposed folds sidewalls of the front stack. They may be arranged so that there are not stack holdback members at the edges sidewalls of the stack on the front of the stack. The holdback members may be arranged to engage the front to the stack in a central location along each folds sidewall of the stack.

Defined separately from the stack, the one or more holdback members may include a plurality of holdback members arranged on opposed sidewalls of the housing defining opposed sides of the interior volume. Two opposed holdback members may be provided on respective opposed sidewalls and centrally located along a side of the interior volume.

The dispenser may include a removable or openable cover and a housing including sidewalls defining sides of the interior volume. When the cover is removed or opened, the holdback members are arranged so as to retain the stack at a front end of the sidewalls.

The stack engaging part of each of the holdback members typically extends across the interior volume perpendicularly or substantially perpendicularly (or at least having a greater perpendicular component than parallel component) to a sidewall of the housing at least partly defining the interior volume in the stack engaging orientation. The stack engaging part of the each of the holdback members extends along the sidewall (e.g. parallel or substantially parallel or at least having a greater parallel component than perpendicular component) in the stack loading orientation. That is, the stack engaging part extends in the above described x-y plane in the stack engaging orientation and along the z axis in the stack loading orientation.

The hinge of each holdback member is configured to allow the stack engaging part to pivot thereabout from an orientation extending perpendicular or substantially perpendicular to a sidewall of the housing to an orientation extending parallel or substantially parallel to the sidewall of the housing. In an embodiment, stop surfaces define a stack engaging stop position and a stack loading stop position. The stack engaging stop position defines the maximum turn of the stack engaging part about the hinge in a direction toward the dispensing mouth and still defines an orientation of the stack engaging part relative to the sidewall for engaging a front of the stack and spacing the front of the stack rearwardly from the dispensing mouth. The stack loading stop position defines the maximum turn of the stack engaging part about the hinge in an opposite direction, away from the dispensing mouth. The stack loading stop position may provide for stack clearance during loading and may define a position in which the stack engaging part is most closely aligned with parallel to a sidewall of the housing.

The stack engaging part of each of the holdback members may include a flat surface for interfacing with the top of the stack, wherein the flat surface extends perpendicularly or substantially perpendicularly to the sidewall of the housing in the stack engaging orientation. A flat surface may define a favourable sliding engagement with the foremost sheet product in the stack for smooth dispensing.

The stack engaging part may extend freely from a sidewall of the housing (e.g. like a cantilever) in the stack engaging orientation.

The stack engaging part of each of the holdback members is arranged to engage in a margin area of the front of the stack in the stack engaging orientation. That is, a major central area of the front of the stack is not contacted and it is only a peripheral margin area at which the stack engaging part is configured to contact.

The stack engaging part of each of the holdback members is shaped in a tab form. Accordingly, the stack engaging part of the holdback members may be described in the following as holdback tabs. That is, the stack engaging part projects only to an adjacent margin of the front of the stack, e.g. projects by 3 or 4 cm or less, and extends along the margin by a minor distance (i.e. less than 50 percent) relative to a length of the margin along that side of the front of the stack, e.g. optionally 4, 5 or 6 cm or less. The tab like form provides for a low contact engagement to ensure smooth dispensing. The tab form may extend along a margin of a front of the stack by a greater amount than it projects across the margin.

The stack engaging part may include opposed major surfaces and be essentially planar in form. The planar stack engaging part may extend perpendicularly from a sidewall of the housing defining the interior volume when in the stack engaging orientation. That is, the opposed major surfaces extend in an xy-plane defined above.

The stack engaging part of each of the holdback members may be turnable about the hinge in a/the first direction away from dispensing mouth from the stack engaging orientation to the stack loading orientation.

The one or more holdback members may each include the above described hinge, one or abutment surfaces, one or more stop surfaces, the housing part, the bridge portion, one or more mounting means and the stack engaging part. The holdback members may each be formed as an integral piece mountable to the housing. The integral holdack members may be formed by moulding such as by injection moulding.

The dispenser may include a removable or openable cover defining the dispensing mouth. The cover is able to be removed or opened in order to reveal an entrance to the interior volume to provide access to the interior volume for loading. The holdback members may be able to engage the stack and hold the stack in position when the cover is removed. When the cover is replaced or closed, the entrance is partly covered so that sheet products are to be removed from the stack through the dispensing mouth. Access is only provided to the entrance to the interior volume for the purpose of loading a stack when the cover is removed. Thus, the holdback members are able to hold the stack within the interior volume even when the cover is removed. Removal of the cover member may involve translation relative to the housing, whereas opening may involve pivoting of the cover member about a hinge connection of the cover member and the housing.

Above, the stack is defined as spaced from the dispensing mouth, and a dispensing direction is defined as passing through the dispensing mouth. This is to be understood in dispensing use when the cover is closed or replaced, not when the cover is removed or opened.

The housing may define at least four sides of the interior volume corresponding to four sides of a cuboid shaped stack.

The housing may include sidewalls according to the below definitions given with respect to the third aspect.

The housing may include a supporting surface for supporting the stack. The supporting surface may be according to the definitions given below with respect to the third aspect. The supporting surface may be surrounded by the sidewalls of the housing, with the sidewalls extending normally relative to the supporting surface to define at least in part the interior volume. In fact, the supporting surface and the sidewalls constrain the stack in all sidewise directions and rearwardly.

The stack engaging parts of the holdback members may be rigid such that when the interior volume is filled with a stack and held within the interior volume by the holdback members when the stack engaging parts are in the stack engaging orientation, the stack engaging parts do not curl or flex during dispensing of sheet products.

In a third aspect, there is provided a dispenser for interfolded napkins (sheet products), the dispenser including a container (housing) having a supporting surface for supporting a stack of interfolded napkins, the supporting surface extending in a horizontal plane, and being surrounded by side walls of the housing extending in a vertical direction perpendicular to the supporting surface, and defining a dispensing opening (entrance to the interior volume) opposite the supporting surface. The dispenser further includes at least one tab (stack engaging parts of the holdback members) arranged in the container for retaining the stack of napkins during withdrawal of a napkin from the stack. The at least one tab is pivotably arranged in relation to the container between a holding position (stack engaging orientation), in which the tabs extend horizontally over at least a portion of the dispensing opening, and a refill position (stack loading orientation), in which the tab is directed away from the dispensing opening.

In the third aspect:

(1) the one or more tabs are pivotable between the holding and refill positions about a flexible hinge; and/or (2) the one or more tabs are pivotable between the holding and refill positions about a hinge by turning in a first direction, and the dispenser includes one or more stop surfaces for limiting turning of the tabs about the hinge in a second direction opposite to the first direction to maintain the holding position in which the tabs extend horizontally over at least a portion of the dispensing opening.

The third aspect and the below optional features are able to be applied to the first and second aspects. The reverse is true also, namely that the first and second aspects and the above optional features are able to be combined with the third aspect. The wording in brackets is merely so as to provide a link between the different terminology of the various aspects to assist in combinability.

That the tabs extend horizontally over at least a portion of the dispensing opening means that, when in the holding position, the tabs will extend in a direction having a horizontal component extending over at least a portion of the dispensing opening, so as to enable holding of the stack inside the dispenser during withdrawal of napkins.

The following more detailed features are worded in terms of the terminology of the third aspect, but are applicable, separately, to the corresponding features of the above first and second aspects.

Hence, in the holding position, the tabs per se could extend in various directions from the dispenser side walls. According to embodiments, the tabs could extend in a direction forming an angle between 50 degrees and 130 degrees in relation to a vertical side wall, between 70 and 110 degrees, between 80 and 100 degrees, or between 85 and 95 degrees, or about 90 degrees.

In the refill position, the tabs are directed away from the dispensing opening, potentially meaning that the tabs will extend in a direction having no horizontal component extending over at least a portion of the dispensing opening. Accordingly, in the refill position the tabs might assume an essentially vertical position, extending in line with a vertical side wall, or it might assume any position in which it is directed outwardly from the sidewalls surrounding the dispensing opening.

The tabs being pivotable between two selectable positions will enable refill of napkins via the dispensing opening without hinder from the tabs, when the tabs are in the refill position, while still enabling all the benefits achievable by tabs during use of the dispenser, when the tabs are in the holding position.

Hence, the procedure for refilling the dispenser with new napkins may be simplified. Moreover, the risk of crumpling or damaging the appearance of the new napkins during refill of the dispenser is reduced.

As used herein, the term "dispensing opening" means a portion of a container being open towards the ambient and being used for providing access to the inner space of the container.

As used herein, the term "dispensing mouth" means an opening through which items are dispensed.

As used herein, by the term "adjacent" it is meant items being nearest in space or position, immediately adjoining without intervening space, touching; and also items being near or close but not necessarily touching.

The dispenser includes a container (housing) having a supporting surface for supporting a stack of interfolded napkins, the supporting surface extending in a horizontal plane, and being surrounded by side walls extending in a vertical direction perpendicular to the supporting surface and defining a dispensing opening opposite the supporting surface. The dispenser further includes at least one tab (stack engaging parts) arranged in the container for retaining the stack of napkins during withdrawal of a napkin from the stack.

The container (housing) is intended to receive a stack of napkins to be dispensed from the dispenser. Accordingly, the shapes and dimensions of the inner container may be adapted to fit an intended stack.

In particular embodiments, the support surface has a generally rectangular shape, corresponding to the shape of the stack of napkins to be introduced into the container. Slight deviations from the general shape such as rounded corners etc. are conceivable. As used herein, the term "rectangular" is to include all four-sided plane figures with four substantially right angles.

The side walls of the container will extend perpendicular to the plane of the supporting surface of the container.

The side walls delimit the container (housing) space (the interior volume) and the size of the dispensing opening and are arranged to contain and support the stack of interfolded napkins without deforming the napkins. The side walls will hence also provide side support for the stack of napkins, when the container is in use.

For the stack to be supported in horizontal directions, the side walls should extend vertically so as to surround and support the stack around the rectangular periphery thereof. To this end, it is necessary that the side walls have a certain extension along the periphery of the bottom surface However, it will be understood that the side walls need not form a closed wall surface, but could be provided with openings or slots, if desired. Alternatively, the side walls could be formed by a number of ribs arranged vertically and at a distance from each other.

In a particular embodiment, the side walls form essentially closed side walls along the full perimeter of the supporting surface. Accordingly, the container will assume a box shape, being open upwardly at the dispensing opening.

In accordance with embodiments, the supporting surface may be constituted by a bottom wall of the container, from which the side walls extend vertically.

Alternatively, the container (housing) may include a bottom wall, from which the side walls extend vertically, in addition to said supporting surface.

In this case, the supporting surface would be arranged vertically above the bottom wall, towards the dispensing opening of the container.

In particular embodiments, the support surface and/or the bottom wall forms a generally complete surface, i.e. an entire wall. However, it is also conceivable to form the support surface and/or the bottom wall using e.g. ribs or ledges being interconnected for supporting the stack of napkins, or for forming a bottom of the container.

In particular embodiments, the supporting surface (platform) is biased towards the dispensing opening of the container.

The supporting surface may be biased using any conventional biasing means. In a particular embodiment, the supporting surface is biased towards the dispensing opening of the container by a spring, for example a conical spring.

Advantageously, the supporting surface (platform) is vertically movable inside the container between a lower position, and an upper position adjacent the dispensing opening, and the upper position of the supporting surface is determined by at least one horizontally extending tab arranged in the inner container.

When the dispenser includes a bottom wall being separate from the supporting surface, the lower position of the supporting surface may be located adjacent the bottom wall.

The size and arrangement of the tabs may be selected in relation to the spring force obtained from the bias, so as to ensure that the upper panel (front) of a stack of napkins is kept in position when a napkin is withdrawn from the dispenser, and avoid that multiple napkins are unintentionally withdrawn.

As described in the above, the supporting surface (platform) may be vertically movable inside the inner container between a lower position adjacent the bottom wall of the inner container, and an upper position adjacent the dispensing opening of the inner container.

Advantageously, the supporting surface (platform) is generally rectangular to support a stack of napkins. The outline of the supporting surface should be received between the side walls, such that the side walls may guide the movement of the supporting surface during its movement between the lower and upper positions.

The outline of the supporting surface (platform) may be provided with one or more protrusions protruding from said outline in the horizontal direction. Advantageously, said protrusions protrude into vertically arranged rails provided on one or more side walls of the inner container (housing) to guide the vertical movement of the supporting surface between the lower and upper positions inside the container.

A spring or other suitable biasing element may advantageously be arranged between the supporting surface (platform) and a bottom surface of the container (housing). In particular embodiments, if using a conical spring, the spring may be arranged with its largest end surface facing towards the bottom wall of the inner container, and its smallest end surface facing towards the supporting surface.

The bottom surface of the container (housing) is advantageously provided with a track into which one end of the spring, for example the large end surface of the conical spring, will fit. In a similar manner, the underside of the supporting surface (platform) may be provided with a corresponding track arranged to fit the opposite end of the spring, i.e. the smaller end surface of the conical spring. Fitting the spring end surfaces into tracks will prevent said spring end surfaces from slipping on the biasing surfaces and thereby stabilize the biased movement of the supporting surface between the lower and upper positions.

When the dispenser is completely filled with a stack of napkins, the supporting surface will be pressed downwardly, against the bias, to assume its lower position. A top panel of the stack will abut the tabs, and thereby restrict the upward movement of the supporting surface.

As napkins are dispensed, the height of the stack contained in the dispenser will diminish, allowing the supporting surface to move vertically upwards. Accordingly, the top panel (front) of the stack will continuously abut the tabs.

Should the dispenser be completely emptied, the supporting surface will eventually abut the tabs, and reach its upper position.

The tabs are to be pivotable about the hinge arranged in relation to container, between a holding position, in which the tabs extend at least horizontally over a portion of the dispensing opening, and a refill position, in which the tabs are directed away from the dispensing opening.

Hence, the tabs may assume a holding position, in which the tabs extend at least horizontally over a portion of the dispensing opening, and thereby are active to form a hinder against withdrawal of the napkins in a stack comprised in the dispenser.

The tabs are pivotable from said holding position to a refill position, in which the tabs are directed away from the dispensing opening.

The tabs being directed away from the dispensing opening means that there is no component of the tabs extending horizontally over the dispensing opening. Instead, the tabs could be directed e.g. substantially vertically, or in a horizontal direction away from the dispensing opening.

The tabs, when in the holding position, will extend partially over the dispensing opening of the container.

A suitable extension may be determined for a specific dispenser, to achieve sufficient hold-back of the stack of napkins while allowing for withdrawal of the topmost (foremost) napkin. Hence, the extension may depend e.g. on the bias, on the dimensions of the dispenser and the napkins to be introduced therein, and/or the materials of the tabs. The extension may be about 1-4 cm from the side walls.

The horizontal extension of the tabs is to be measured in a dimension extending from said side wall.

The tabs will also have a length extension extending along the container side walls. The tabs are arranged to extend over only a portion of the container side walls, e.g. 2 to 8 cm, or 3 to 5 cm.

Advantageously, at least two tabs (stack engaging parts of respective holdback members) may be provided, extending from opposing side walls of the container. The two tabs may extend from two opposing side walls of the container (housing). The use of two tabs provides greater hold back security, for securing that only the uppermost (foremost) napkin is withdrawn from the stack upon pulling a leading end thereof.

Also, more than two tabs may be arranged, for example four or more tabs.

The tabs may be arranged on opposing sides of the container, and diagonally over the supporting surface. This arrangement might facilitate the introduction of a stack of napkins in the container, past the tabs.

The tabs may be arranged at an upper end portion (front end portion) of a side wall of the container (housing).

The tabs may have any shape suitable to provide a tab surface suitable for the purpose of holding back the stack. For example, the tabs may be generally rectangular, triangular, or T-shaped. The tabs may be pivotally attached to the side walls along an entire side portion of their outer contour, or only along a portion thereof. The tabs may include a stem (e.g. with a T-shaped tab), where the stem is used for the pivotal attachment about the hinge, and from which a tab surface extends in one or more directions t for abutting the stack.

In particular embodiments, the side walls form upper (front) edges, and the tabs are arranged at said upper edges of the side walls. With such an arrangement, substantially the entire space formed by said container will be available for containing a stack of napkins. Moreover, the upper edges form a suitable basis for fastening the tabs (holdback members including the stack engaging parts).

Advantageously, the tabs (holdback members including stack engaging parts) may be arranged at the upper edges of the side walls via a snap-fit connector.

In particular embodiments, the tabs may be pivotably arranged via the hinge, arranged at the container (housing). Moreover, the hinge could suitably be arranged at the upper (front) edges of the side walls, as suggested in the above.

Advantageously, the tab (stack engaging part) is rigid. That is, the tab or stack engaging part is rigid relative to the flexibility of the hinge.

That the tab is rigid may further mean that it substantially does not flex when a napkin is withdrawn from the stack, and the stack is held back by the tabs being in its holding position. Hence, a stable fixation of the stack is achieved.

As mentioned above, the side walls define the dispensing opening (entrance to the interior volume) arranged at the upper (front) portion of the dispenser. The dispensing opening in the context of the present disclosure is a part of the container being open towards the ambient and providing access to the inner space of the container.

Advantageously, the outline of the dispensing opening will generally correspond to the shape of the supporting surface. This will provide a relatively large opening, which may easily be refilled with a stack of napkins.

Hence, the container may be filled with napkins by introduction thereof via the dispensing opening, when the tabs are in the refill position. Once the container is filled, the tabs may be pivoted from the refill position to the holding position, so as to maintain the stack in position in the container, also during withdrawal of a napkin.

In accordance with embodiments, the dispenser may further include a dispensing mouth (the dispensing mouth). Hence, the form, shape and size of dispensing mouth may be adapted to various purposes, without the restrictions posed on the dispensing opening.

The dispensing mouth may have any suitable shape, such as oval or rectangular, provided that the dispensing mouth does damage the napkin to be dispensed. In particular embodiments, the dispensing mouth may be arranged not to crease the napkin, and/or to provide sufficient support for the leading end of the napkin, such that the leading end of the napkin is in its upright position prior to use.

The dispensing mouth has a smaller open area than the dispensing opening. With "open area" it is meant the area of the opening or mouth in a plane perpendicular to a withdrawal direction of a napkin. Hence, the form, shape and size of dispensing mouth may be adapted to various purposes, e.g. to allow withdrawal of a napkin, but not refill of napkins there through.

Advantageously, the tabs (stack engaging parts) may be arranged in the container (housing) at a vertical (front to rear) distance from the dispensing mouth of the dispenser, said vertical distance is at least 1 cm, at least 2 cm, or at least 3 cm.

Hence, a space will be provided between the dispensing mouth and the uppermost (foremost) panel of the stack. Thereby, it is ensured that the stack is not clamped against the dispensing mouth, which would risk complicating the removal of napkins from the stack.

In embodiments where the supporting surface is biased towards the dispensing opening, the top (foremost) panel of the stack will always be located at the position of the tabs (stack engaging parts), and the vertical distance between the top panel of the stack and the dispensing mouth will always be constant. This means that a specific length of the leading end of the uppermost sheet will extend from the top panel and out via the dispensing mouth to be presented to a user. By selection of the vertical distance between the tabs and the dispensing mouth, a suitable length for upright presentation of the end of the sheet may be achieved.

Advantageously, the dispensing mouth may be aligned with the dispensing opening. Accordingly, a stack may be arranged on the supporting surface with a leading end of the top napkin of the stack arranged in a longitudinal direction, and then pulled through the dispensing opening and the dispensing mouth, without twisting the napkin.

In particular embodiments, the dispensing mouth is elongate having a maximum length extending in parallel to a pair of opposing side walls of said container.

Expressed in relation to the longitudinal extension of the supporting surface of the container, the dispensing mouth may have a longitudinal extension of at least 75%, at least 85%, or at least 90% of the length of the supporting surface extending between two opposing side walls. Also, the longitudinal extension of the dispensing mouth may be 100% of the longitudinal extension of the supporting surface, i.e. the longitudinal extension of the dispensing mouth is equal to the longitudinal extension of the supporting surface.

Accordingly, dispensing mouth will be able to receive the full width, or close to the full width of the napkins of the stack supported by the supporting surface, without crimpling the napkins. Hence, a smooth presentation of the napkins is enabled.

In accordance with embodiments, the container (housing) may be an inner container, adapted to be positioned inside an outer container, to form the dispenser.

Moreover, in this case, in a particular embodiment, the outer container includes the dispensing mouth. In combination with embodiments of the first and second aspects described above, the outer container may include the cover.

In accordance with embodiments, the outer container includes an outer sleeve including the dispensing mouth, the outer sleeve forming at least one open end portion being arranged to receive the inner container such that the inner container is insertable into the outer sleeve along an insertion direction.

Advantageously, said insertion direction may extend in parallel to said horizontal plane, and, when inserted in the outer sleeve, the dispensing opening of the container is aligned with the dispensing mouth of the outer sleeve.

Hence, the dispensing mouth will be positioned over the items inside the container, so as to be aligned with a leading end of the stack of napkins, when the inner container is located inside the outer sleeve.

Advantageously, the dispensing mouth may be open at least towards the open end of the outer sleeve.

Advantageously, the outer sleeve may form two opposite open end portions, and the dispensing mouth is open towards both open end portions, such that the inner container is insertable into the outer sleeve along two opposing insertion directions.

In particular embodiments, the length of the outer sleeve along the insertion direction substantially corresponds to the length of the inner container along the insertion direction.

When the dispenser is being used, a stack of interfolded napkins is placed on the supporting surface of the container. The stack of interfolded napkins may have a rectangular shape with rectangular or square bottom surface corresponding to the trailing panel of the last napkin in the stack. The stack may have any suitable dimensions such as any suitable height, width and length. The width and length dimensions are defined by the dimensions of the bottom surface of the stack and the height is measured perpendicular to the bottom surface and is determined by the number of napkins in the stack as well as the number of plies and panels in each napkin. The individual napkins may include one or more plies or layers and may have been folded into two or more panels.

The sheet products or napkins may be any kind of napkins, wipes, paper towels, etc. The material may be a fibrous material of any suitable kind such as cellulose based paper materials, with or without admixture of man-made fibres, binders and fillers. The napkins may include only man-made fibres. However, it is usually desired that a napkin has some degree of absorbency or that it at least is wettable. If the fibrous material contains a large proportion of fibres of a hydrophobic character implying that the fibres are non-wettable, it may be suitable to treat the material with a wetting agent. Wetting agents and other additives are well known to the person skilled in the art and will not be further discussed herein. The napkins may have any suitable shape and/or size and may be embossed, perforated, printed and dyed if desired. The napkins may be single-ply sheets of material or may include two or more plies of the same or different materials. In the stack, the napkins are folded at least once in order to obtain an interfolded arrangement with interconnected panels. However, the napkins may be additionally folded in order to reduce their planar size to a practical dimension as is well known in the art. Accordingly, any type of interfolding of the napkins may be used, as known in the art.

Numerous different materials and combinations of materials may be selected to provide a dispenser as described herein.

It is noteworthy that the dispenser according to the present disclosure is intended for multiple use. In other words, the dispenser is intended to be refilled, rather than disposed of, when empty.

The dispenser arrangement according to the disclosure has a simple construction and may be made from inexpensive and readily available materials. Moreover, the dispenser arrangement has a surprisingly reliable function and will not damage the dispensed napkins.

BRIEF DESCRIPTION OF THE DRAWINGS

Embodiments of the disclosure will now be described by way of example only and with reference to the accompanying drawings, of which:

FIGS. 3*a* and 3*b* show a stack engaging part that is turnable about a living hinge between a stack engaging orientation as shown in the figures in which the profile of the holdback member extending normally to a sidewall of the housing of the dispenser is relatively great and a stack loading orientation as shown in FIG. 7 in which that profile is relatively small. FIGS. 3*a* and 3*b* also show a configuration of one or more stop member surfaces each provided as part of an overhang member disposed so that the stop surfaces engage the stack engaging portion to limit turning of the stack engaging portion about the living hinge in a direction toward a dispensing month of the dispenser.

DETAILED DESCRIPTION OF A PARTICULAR EMBODIMENTS

Figure 1:
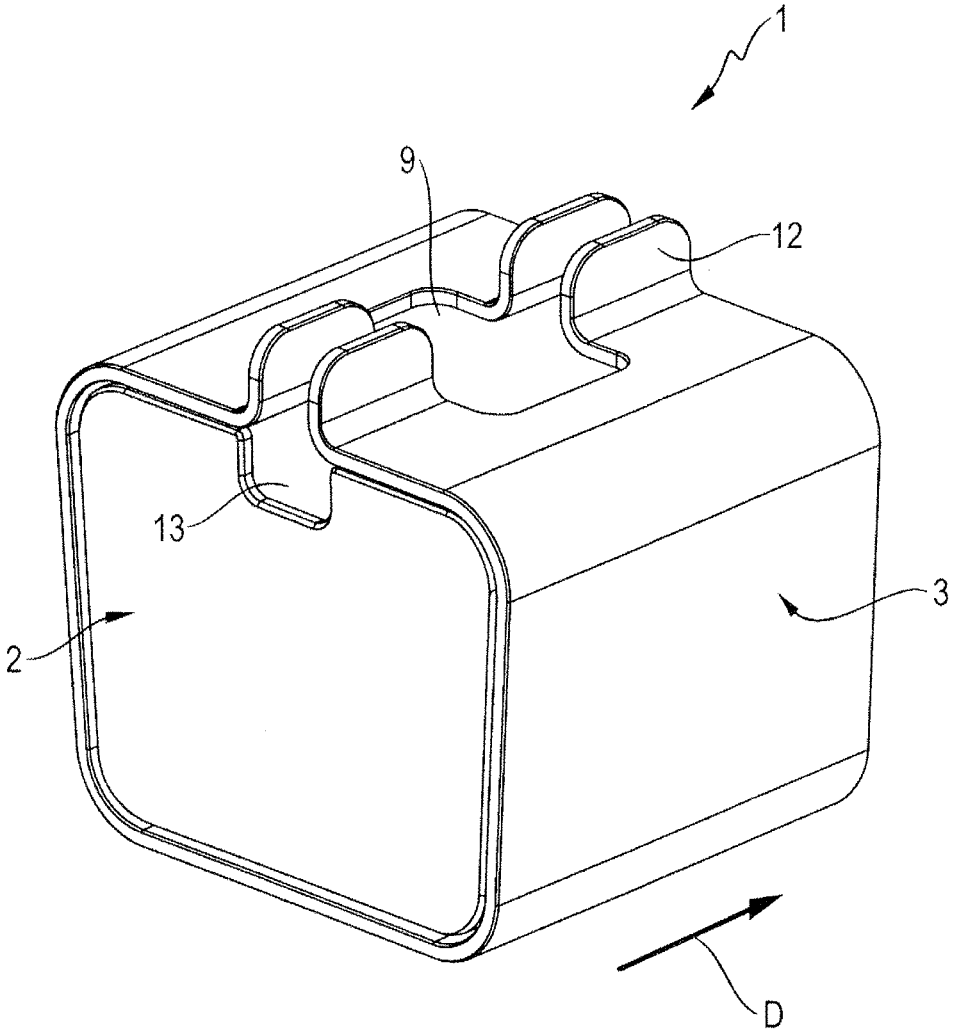
FIG. 1 illustrates an embodiment of a dispenser for dispensing interfolded napkins.

In the following, different embodiments of the present disclosure will be described by reference to the attached Figures. Identical or similar features will be denoted by the same reference numerals and repeated description thereof will be avoided.

Figure 3A:
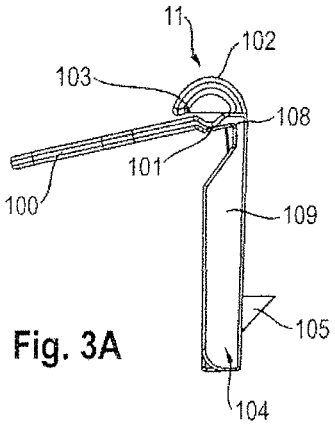
FIGS. 3*a* and 3*b* respectively show side and perspective views of a holdback member for use in the dispenser of FIGS. 1, 1*a*, 2, 4, 4*a*, 4*b* and 5, and other sheet product dispensers.
Figure 3B:
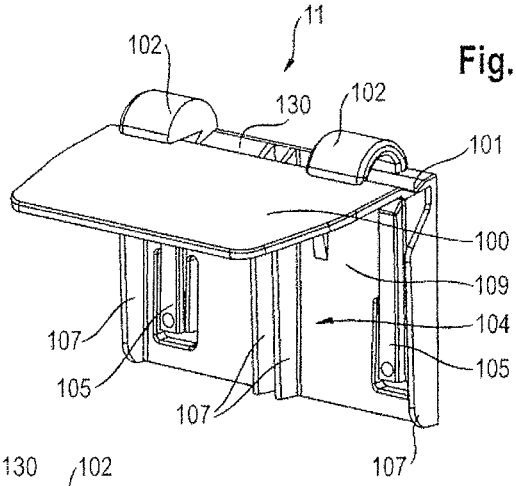

FIGS. 3*a* and 3*b* show an embodiment of a container including holdback means in accordance with the present application.

Figure 6:
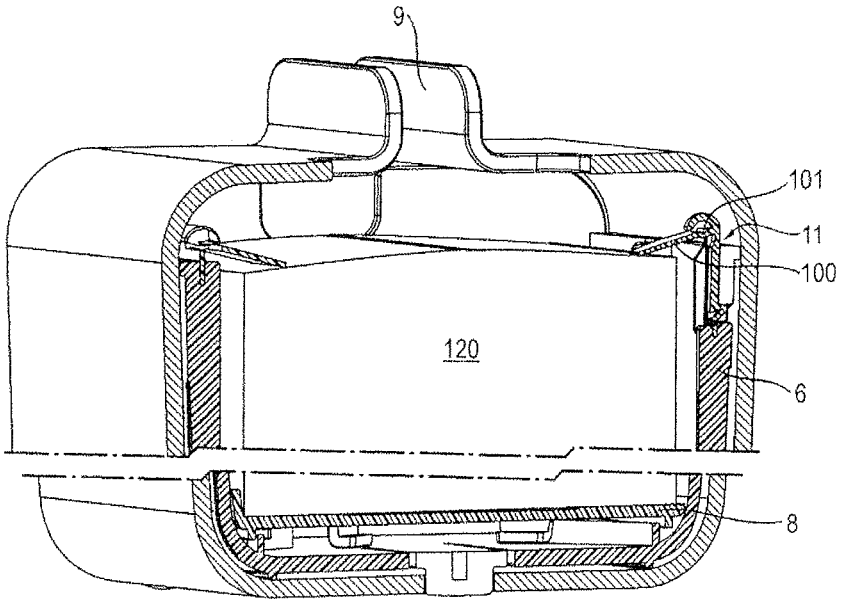
FIG. 6 shows the holdback members when engaging a stack so as to hold the stack at a spacing away from the dispensing mouth.
Figure 7:
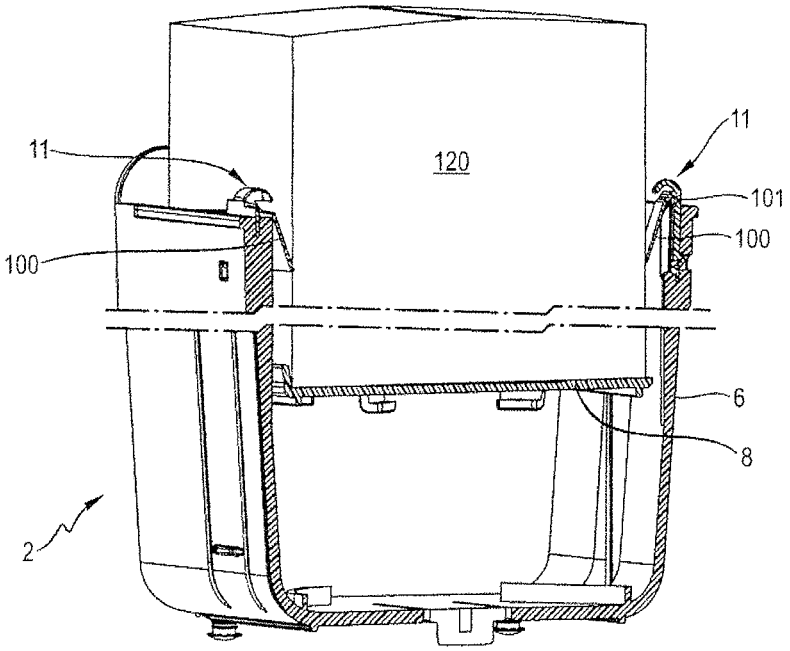
FIG. 7 shows the holdback members of the dispenser of FIG. 6 each with the stack engaging part collapsed into a loading configuration to allow for passage of a stack of napkins.
Figure 8:
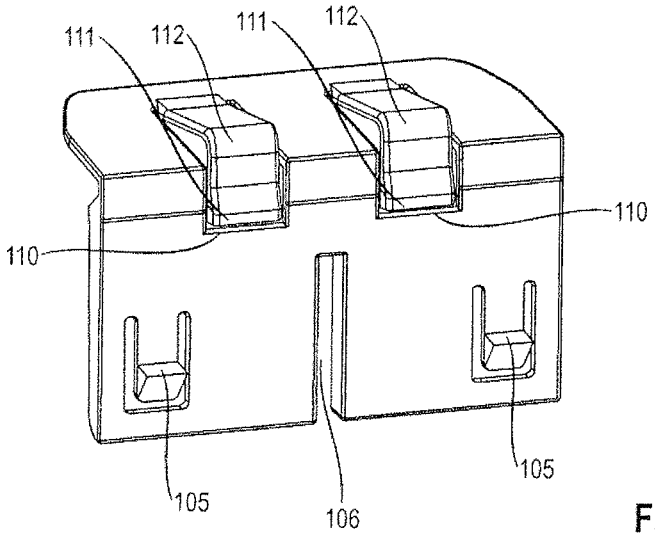
FIG. 8 shows an alternative holdback member, particularly emphasising an alternative solution for the one or more stop surfaces in which the stop surfaces are provided as part of a fixed portion of the holdback member relative to a sidewall of the housing and abutment surfaces are connected to the stack engaging part so as to turn therewith about a hinge.

FIGS. 1, 4, 5, 6 and 7 show embodiments of a dispenser in which an inner container including holdback members in accordance with the present application may be used. The holdback members are shown generically in FIG. 2, with a detailed implementation thereof being shown in FIGS. 3*a*, 3*b*, 6 and 7. An alternative implementation of stop surfaces of the holdback members is shown in FIG. 8 that is applicable to the holdback members of the preceding embodiments. Further, the holdback members disclosed herein can be applied to dispensers other than that shown in the figures.

The dispenser 1 includes an outer sleeve 3 and an inner container 2. The inner container 2 can be inserted into the outer sleeve 3, as it is shown in the schematic perspective diagram of FIG. 1. The inner container 2 of the dispenser 1 includes a dispensing opening 7 for dispensing e.g. interfolded napkins which are contained inside the inner container 2. The outer sleeve 3 includes a dispensing mouth 9 which is aligned with the dispensing opening 7 of the inner container 2 when the inner container 2 is inserted into the outer sleeve 3. This enables a reliable dispensing process of the interfolded napkins from the inner container 2.

The outer sleeve 3 forms an open end 10 through which the inner container is insertable into the outer sleeve 3 along an insertion direction D, extending in parallel with the dispensing mouth 9. The dispensing opening 7 of the inner container 2 is substantially larger than the dispensing mouth 9 of the outer sleeve 3 such that the dispensing opening 7 of the inner container 2 will not influence the dispensing characteristics of the dispensing mouth 9 of the outer sleeve 3, but simply enables dispensing of the napkins through the aligned dispensing opening 7 and dispensing mouth 9 when the inner container 2 is received in the outer sleeve 3.

The dispensing mouth 9 of the outer sleeve 3 is open towards the open end 10 of the outer sleeve 3. Accordingly, the inner container 2 may be inserted into the outer sleeve 3, while a leading end of a stack of napkins contained in the inner container 2 is allowed to protrude vertically from the dispensing opening 7 of the inner container 2. In this case, the protruding leading end of the stack may be introduced into the dispensing mouth 9 via the open end thereof as the inner container 2 is introduced into the outer sleeve 2 via the open end 10 thereof. Hence, set-up of the dispenser 1 in a ready-to use configuration with a leading end of the stack being present in the dispensing mouth is facilitated.

In the illustrated embodiment, the outer sleeve 3 forms two opposing open ends 10, and the dispensing mouth 9 is open towards both open ends 10 of the sleeve. Accordingly, the inner container 2 may be introduced into the outer sleeve 3 along any one of two opposing insertion directions D.

However, it will be understood that other embodiments, displaying only one open end 10 of the outer sleeve 3 and one corresponding opening of the dispensing mouth 9, may also be envisaged.

Figure 2:
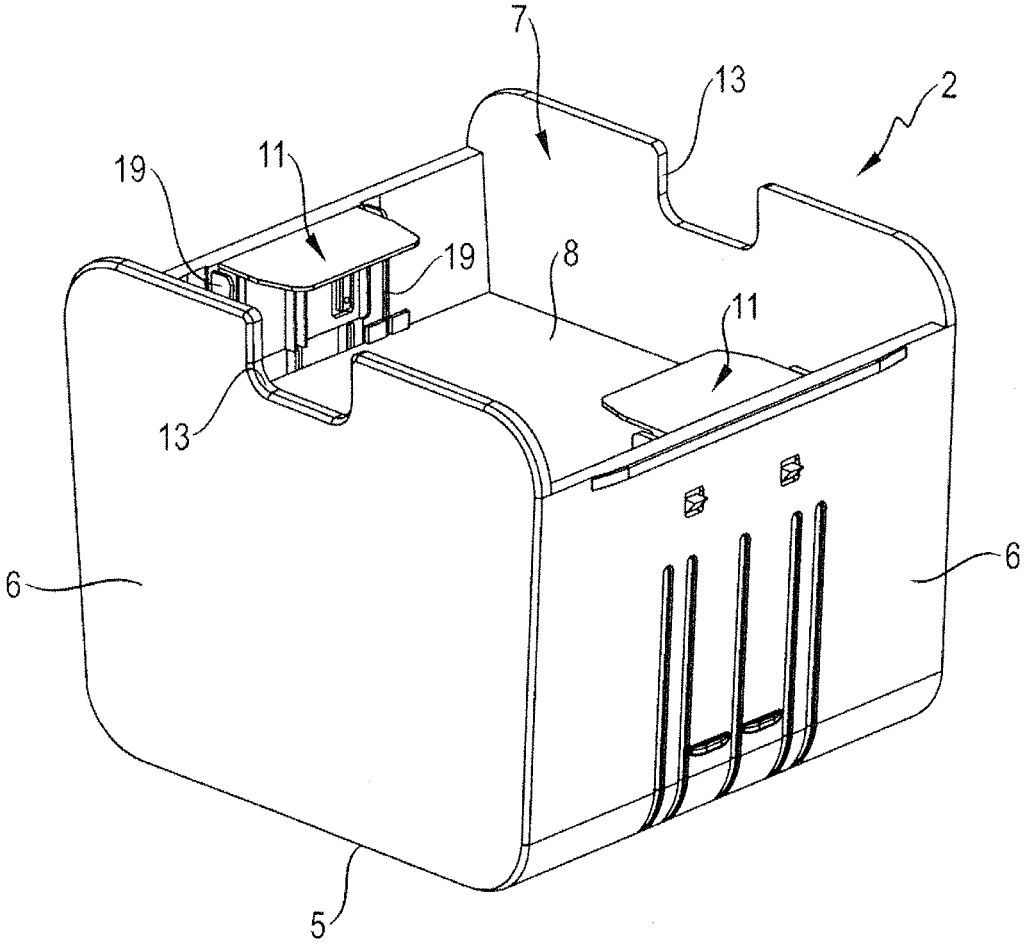
FIG. 2 illustrates a first embodiment of an inner container which may be used with the embodiment of a dispenser of FIG. 1.

FIG. 2 shows a perspective view of the inner container 2. As can be seen, the inner container 2 has a bottom wall 5, and side walls 6 which extend in the vertical direction perpendicular to the bottom wall 5. The side walls 6 define the dispensing opening 7, which is located opposite the bottom wall 5. A supporting surface 8 for supporting a stack of interfolded napkins extends in the horizontal plane inside the inner container 2. Typically, the stack of napkins to be dispensed is held in the volume defined by the side walls 6 and the supporting surface 8.

Figure 1A:
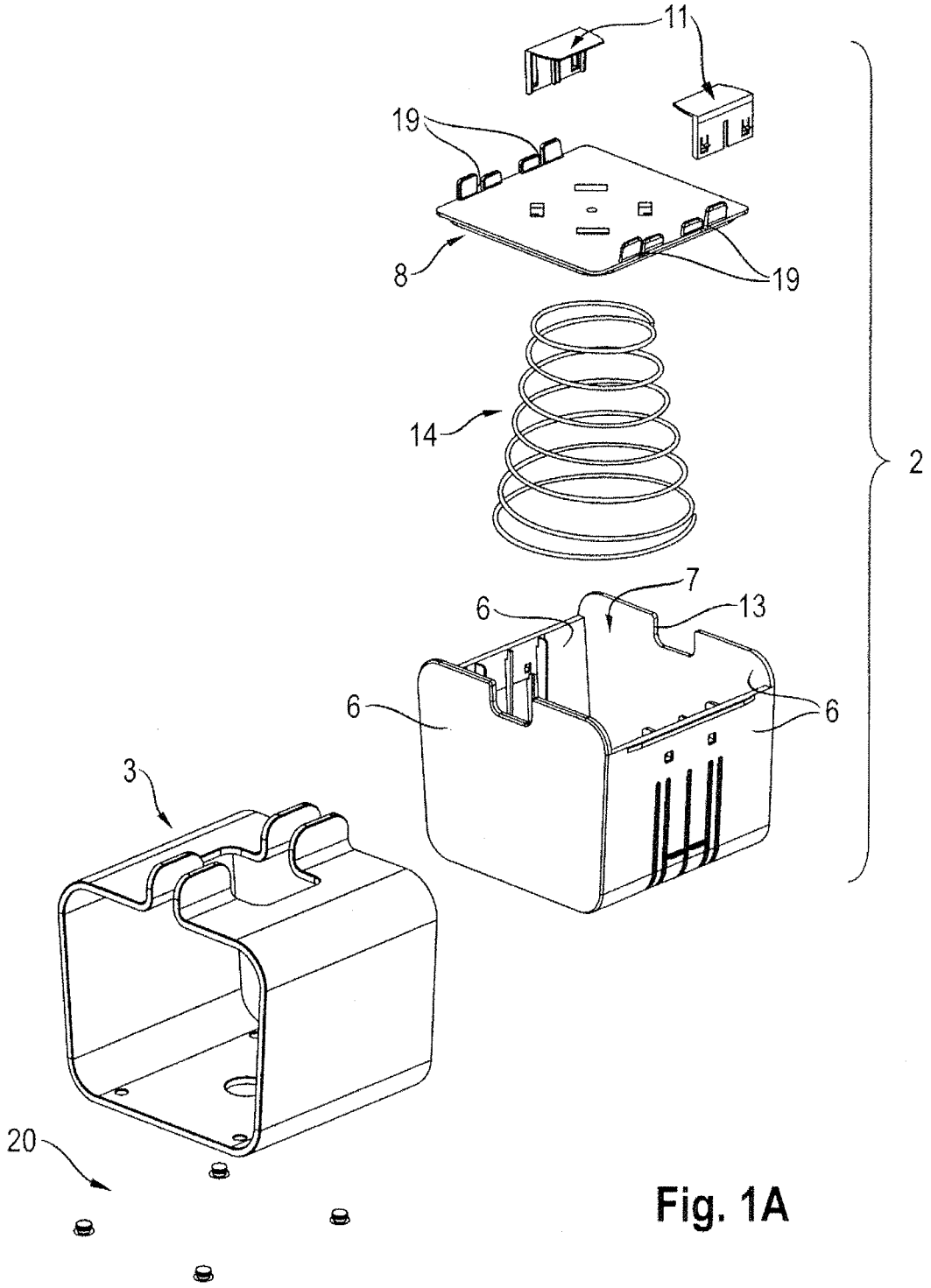
FIG. 1A is an exploded view of the dispenser illustrated in FIG. 1.

The supporting surface 8 is biased towards the dispensing opening 7 by means of a spring 14, for example a conical spring as seen in FIG. 1A. The spring 14 is arranged between the bottom wall 5 and the lower surface of the supporting surface 8, such that largest end surface of the conical spring 14 faces towards the bottom wall 5 of the inner container 2, and its smallest end surface faces towards the supporting surface 8. The supporting surface 8 is vertically movable inside the inner container 2 by means of said biasing spring 14. The supporting surface 8 moves between a lower position adjacent the bottom wall 5, and an upper position adjacent the dispensing opening 7.

The bottom wall of the inner container is advantageously provided with a track 17 into which one end of the spring 14, for example the large end surface of the conical spring, will fit. In a similar manner, the underside of the supporting surface 8 may be provided with a corresponding track 17 arranged to fit the opposite end of the spring 14, i.e. the smaller end surface of the conical spring. Fitting the spring end surfaces into tracks 17 will prevent said spring end surfaces from slipping on the biasing surfaces and thereby stabilize the biased movement of the supporting surface 8 between the lower and upper positions.

The upper position for the supporting surface 8 is determined by one or more holdback members 11 including tabs or stack engaging parts 100 extending in the horizontal direction from the side walls 6 of the inner container 2. In FIG. 2, it is seen how two tabs or stack engaging parts 100 of the holdback members 11 extend from the upper edges of opposing side walls 6 and abut the upper side of the uppermost panel of a stack of napkins. The tabs or stack engaging parts 100 of the holdback members 11 restrict the upward movement of the supporting surface 8, and ensure that the uppermost napkin is kept in position when it is withdrawn from the dispenser 1. The tabs 11 will also prevent that multiple napkins are unintentionally withdrawn at the same time. As napkins are dispensed, the height of the stack contained in the dispenser 1 will diminish, allowing the supporting surface 8 to move vertically upwards. When all napkins have been withdrawn from the dispenser 1, the tabs or stack engaging parts 100 of the holdback members 11 will abut the supporting surface 8.

FIGS. 3*a* and 3*b* show an embodiment of the holdback members 11 pivotably arranged in relation to the inner container 2. In this embodiment, the tabs 100 of the holdback members 11 are movable from a holding position or stack engaging orientation in which the tabs 100 extend at least horizontally over a portion of the dispensing opening 7, and a refill position or stack loading orientation, in which the tabs 100 are directed away from the dispensing opening 7. This arrangement with pivotable tabs 100 will facilitate the loading of a stack of napkins into the inner container 2. FIG. 7 shows an embodiment wherein the pivotable tabs 100 are in a refill position or loading orientation.

In FIGS. 3*a* and 6 it is seen how the tabs 100 of the holdback members 11 as a whole form an angle of about 50° to 130° with the vertical plane including the side wall 6 to which the tabs is attached. Accordingly, the tabs 100 of the holdback members 11 extend in a horizontal direction over the dispensing opening 7 so as to retain a stack of napkins held inside the inner container 2. The downward angle of the tabs 100 is a little greater than a particular configuration that is closer to perpendicular.

The angle is in the stack engaging or holding orientation, which is, for example, closer to perpendicular relative to the vertical plane of the sidewall 6, e.g. 60° to 120°, 70° to 110°, or 80° to 100°.

In FIG. 7, it is seen how the tabs 100 of the holdback members 11 are directed away from the dispensing opening 7, when the inner container 2 is in a refill position. In this orientation, the tabs define an angle of 0° (parallel) to 40° relative to the vertical plane of the sidewalls 6. The angle in the loading configuration is preferably closer to parallel to the vertical plane of the sidewall 6, e.g. 0° to 30°, 0° to 20°, 0° to 10°. The entire dispensing opening 7, as outlined by the side walls 6, is readily available for easy refill of napkins.

FIGS. 3*a* and 3*b* show a more detailed version of each holdback member 11 as compared to that shown in FIG. 2. In FIGS. 3*a* and 3*b*, it is shown that each holdback member 11 includes a stack engaging part 100 that is arranged to extend substantially perpendicularly to the vertically plane of a sidewall 6 in a stack engaging or holding position, which is the orientation shown in FIGS. 3*a* and 3*b*. The holdback members 11 each include a hinge 101, which is a living hinge in a particular embodiment. The stack engaging part 100 is arranged to pivot about the hinge 101 relative to the sidewall 6 from the stack engaging orientation shown in FIGS. 3*a* and 3*b* to a stack loading orientation or refill position as shown in FIG. 7.

The stack engaging part 100 is provided in the form of a tab, defining a flat form having opposed major surfaces that are parallel to one another and having a far smaller thickness direction. The stack engaging part 100 is longer in a direction along the sidewall 6 and is shorter in a direction projecting normally from the sidewall 6. The stack engaging part 100 extends along the sidewall 6 by less than half of the overall length dimension of the sidewall 6 defining part of the stack holding interior volume of the dispenser 1. In the direction projecting normally from the sidewall 6, the stack engaging part extends by distance of less than a third, or by less than a quarter of the full distance across the stack extending normally from the sidewall 6.

Figure 3C:
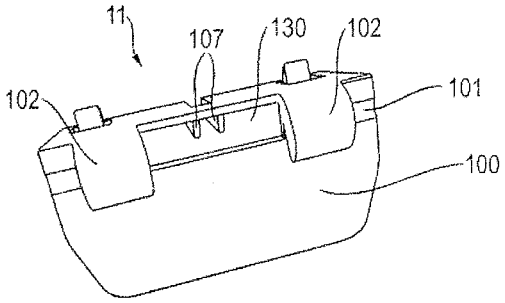
FIG. 3*c* shows a top view of the holdback member of FIGS. 3*a* and 3*c*. The top view shows a gap or open area extending along a hinge axis to increase flexibility of the hinge.

The living hinge 101 can be seen in FIGS. 3*a*, 3*b*, 6 and 7 as defining a relatively thinned portion in the thickness direction as compared to the stack engaging part 100 in order to provide a hinge line about which the stack engaging part 100 rotates. FIG. 3*c* shows one or more gaps 130 in a central location including a part disposed between the overhang members 102. In the specific embodiment, a gap 130 is disposed entirely within the space along the hinge 101 between the overhang members 102. This gap along the hinge 101 serves to increase flexibility to ease turning of the stack engaging part about the hinge, without requiring the hinge 101 to be overly thinned so as to compromise its fatigue performance. In alternative implementations, the one or more gaps may be located elsewhere along the hinge line extending along the hinge 101, such as beneath one or both of the overhang members 102.

The holdback members 11 each include one or more overhang members 102 providing one or more stop surfaces 103 as shown in FIG. 3*a*. The stack engaging part 100 is able to turn about the hinge 101 in a direction away from the dispensing mouth 9 toward the stack loading configuration shown in FIG. 7 from the stack engaging configuration, but also allows turning of the stack engaging part 100 in the opposite direction. The one or more stop surfaces 103 prevent the stack engaging part 100 from extending beyond a limit orientation in the turning direction toward the dispensing mouth 9 so that even when the stack is being urged toward the dispensing mouth 9 by a biasing means, such as the spring 14, the stack engaging part 100 remains in a stack engaging orientation or holding position maintaining the top of the stack at a location spaced from the dispensing mouth 9.

The one or more overhang members 102 include curved surfaces facing the dispensing mouth 9. This curvature provides a graduated interface with a stack during looking to reduce adverse effects of rubbing. This effect could be achieved with suitably angled surfaces.

The one or more stop surfaces 103 are arranged in the embodiment of FIGS. 3*a* and 3*b* so as to engage a side of the stack engaging part 100 facing the dispensing mouth 9. The one or more stop surfaces 103 are provided on a side of overhang member 102 facing away from the dispensing mouth 9. The stack engaging part 100 is configured for turning about the hinge 101 whilst the stop surfaces 103 will remain fixed relative to the sidewall 6 in order to enable that the stop surfaces 103 stop turning of the stack engaging part 100 in the direction toward the dispensing mouth 9.

In an alternative embodiment of one or more stop surfaces 110, the stop surfaces 110 do not engage a dispensing mouth side of the stack engaging part 100, but are instead more remotely located. Specifically, one or more abutment surfaces 111 are each arranged on a free end of a bracket shaped arm 112. The bracket shaped aim 112, and thus the abutment surfaces 111, are configured for turning about a hinge (not shown in FIG. 8) to move the abutment surfaces 111 into engagement with the stop surfaces 110 to define a limit of turning of the stack engaging part 100 about the hinge toward the dispensing mouth 9.

In the embodiment, shown in FIGS. 3*a* and 3*b*, each of the one or more holdback members 11 includes a housing part 104 that is to be fixed to the sidewall 6 of the dispenser 1. In a removable implementation, although non-removable versions may be provided, the fixing includes one or more snap fit members 105 that are able to snap fit into respective opening in the sidewall 6 as shown in FIG. 2. The one or more snap fit members 105 are each disposed at the end of a resilient arm as can best be seen in FIG. 8 in order to provide for snap fit functionality. The holdback members 11 may also each include an open ended slot 106, provided in the embodiment of FIGS. 3*a* and 3*b* but best seen in FIG. 8 that engages a rail on the inside of the sidewalls 6 for alignment purposes. The sidewalls 6 also include brackets 19 as shown in FIG. 2, which in combination with the slot 106 and associated rail of the sidewall 6, allow the holdback member 11 to be slidingly received adjacent to the sidewall 6. A pair of brackets 19 are shown in FIG. 2 for each holdback member 11, serving to constrain the holdback member 11 in a direction along the sidewall 6 and normal to the sidewall 6, while snap fit engagement of the snap fit members 105 with the openings in the sidewalls 6 serve to constrain the holdback member 11 along the vertical direction.

The housing part 104 also includes a plurality of ribs 107, particularly a pair of opposed outer ribs 107 and a pair of central ribs 107. The ribs 107 aid in strengthening the housing part 104 and may also define a stop position for abutting a side of the stack engaging part 100 opposed to the dispensing mouth 9 to define a limit position in the direction of turning of the stack engaging part 100 about the hinge 101 away from the dispensing mouth 9. In this way, the stack engaging part 100 may be disposed substantially parallel to the sidewall 6 as defined by the one or more ribs 107 in the limit position of the stack loading orientation. It may be that the stack engaging part 100 does not need to reach the stop position in order to provide sufficient clearance for the stack to be loaded, as should be clear from FIG. 7.

The housing part 104 and its various components are shown in FIGS. 3*a* and 3*b* as removable components. It is possible, however, to integrate the housing part 104 with the sidewall 6, in which the stack engaging part 101 extends from the sidewall 6, the stop surfaces 102 are provided as part of the sidewall 6, and the snap fit members 105 are not necessary.

Referring to FIG. 3*a*, the holdback members 11 may each include a bridge portion 108 that extends in a direction normal to the sidewall 6 so that the hinge 101, about which the stack engaging part 100 pivots, is offset from an inside surface of the sidewall 6 in the direction normal to the vertical plane defined by the sidewall 6. In this way, clearance is provided for rotation of the stack engaging part 100 about the hinge 101 toward the stack loading configuration.

The housing part 104 may thus include the bridge portion 108 and a side portion 109 that are arranged fixedly perpendicular to one another. The hinge 101 connects the bridge portion, and thus the housing part, to the stack engaging part 100 to allow relative turning, pivoting or rotation therebetween.

The stack engaging part 100—can be a moulded part that is integrally injection molded with the hinge 101. In particular, flow of injection molded material during manufacturing will extend across a thinned portion of the mold defining the hinge 101 so that the polymer chains of the injection molded material, on aggregate, are oriented transverse to a hinge axis of the hinge 101. This provides for flexibility of the living hinge, as well as fatigue resistance. Further, the stack engaging part 100 and the hinge 101 may be integrally molded with the stop surfaces 103, possibly provided as part of the overhanging members 102. Yet further, the housing part 104 (including the sidewall portion 109 and the bridge portion 109) may be integrally injection molded with the stack engaging part 100 and the hinge 101. Thus, the whole piece shown in FIGS. 3*a* and 3*b* and FIG. 8 may be integrally injection molded and be removably attachable to a sidewall 6 of the dispenser 1, or it may be integrally formed with the sidewall 6 in an arrangement not shown in the figures.

It will be understood that numerous alternative embodiments are available, for example as it comes to the size and shape of the pivotable stack engaging parts or tabs. Further, the holdback members 11 can be used in conjunction with all manner of dispensers for sheet products, future or known in the art. For example, holdback members according to the present disclosure may replace the holdback means of the aforementioned WO 2014/037041 A1.

Figure 4A:
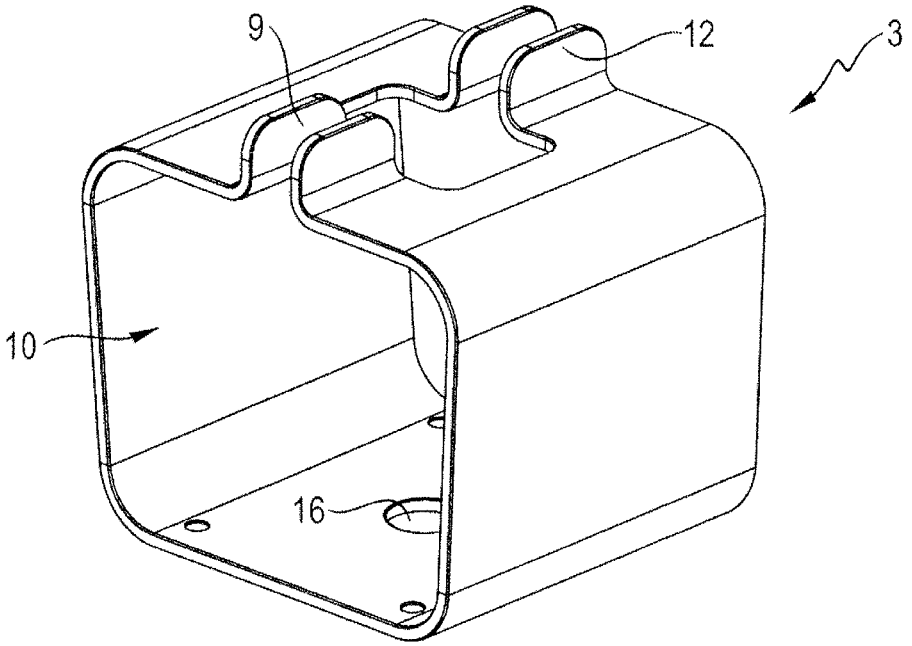
FIG. 4 illustrates the outer sleeve of the dispenser illustrated in FIG. 1.
Figure 4B:
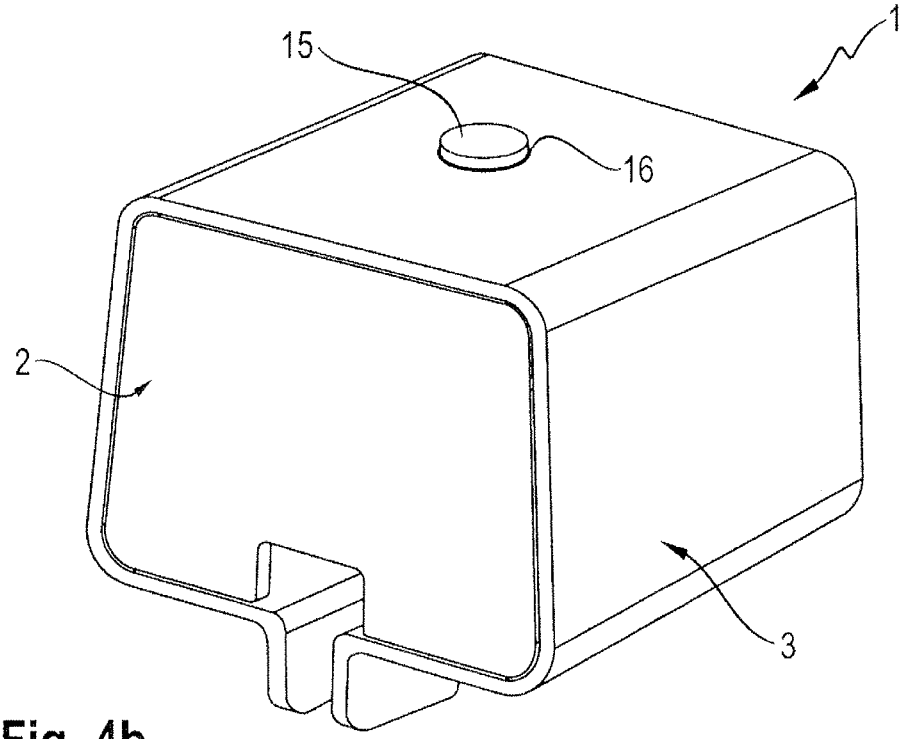

FIG. 4 shows the outer sleeve 3 in a schematic perspective drawing. As will be appreciated, the outer sleeve 3 is, in the form shown in the Figures, can be made from an extruded metallic material, in particular an extruded aluminum or stainless steel material. In a different embodiment, the outer sleeve 3 may be made from an extruded plastic material. In particular, the inner shape of the outer sleeve 3 corresponds to the outer shape of the inner container 2, as becomes immediately apparent from the Figures, in particular FIG. 1.

In another advantageous embodiment, the outer sleeve 3 is made from a band-shaped material which is bent in the form shown in the Figures. The band-shaped material which may be used to manufacture the outer sleeve 3 can be provided in the form of a metal band, in particular an aluminum and/or stainless steel band, or in the form of a band made from a rigid plastic material.

Advantageously, the band-shaped material has a width that is substantially equal to the length of the inner container 2 in the direction D.

Figure 5:
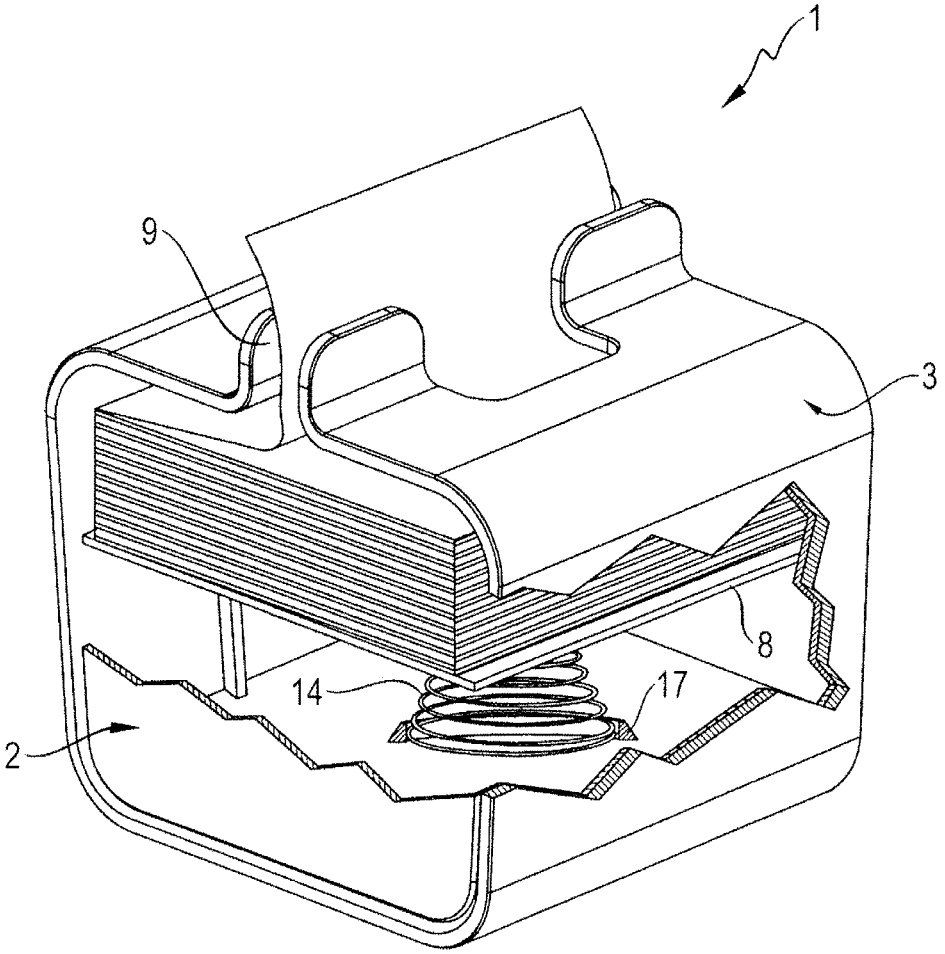
FIG. 5 illustrates the dispenser of FIG. 1 when in a ready-to-use position including a stack of napkins.

The outer sleeve 3 includes a dispensing mouth 9, i.e. an opening through which items are dispensed. As seen in FIG. 5, the dispensing mouth 9 is positioned over the items inside the inner container 2, so as to be aligned with a leading end of the stack of napkins protruding from said dispensing opening 7, when the inner container 2 is located inside the outer sleeve 3.

The biased vertical movement of the supporting surface 8 supporting the stack of napkins towards the dispensing opening 7, automatically positions the protruding leading end from the stack inside the dispensing mouth 9 with a constant length of the leading end extending through the dispensing mouth 9.

To further facilitate the presentation of the leading end present in the dispensing opening 7 inside the dispensing mouth 9, the dispensing mouth 9 includes vertically upwardly protruding edges 12. The vertically upwardly protruding edges 12 enable the napkin to assume an up-right position as seen in FIG. 5.

As illustrated in FIG. 4, the dispensing mouth 9 is advantageously provided with a portion having a greater width extending in a direction perpendicular to the insertion direction D, than the other portions of the dispensing mouth 9. Such a wider portion arranged in the dispensing mouth 9 may facilitate gripping of the napkin, or facilitate the gripping of a leading end of the uppermost napkin when the leading end is lying flatly down on the stack located inside the inner container 2.

The side walls 6 of the inner container 2 need not necessarily be closed, but may be provided with openings or slots. In FIG. 4, it can be seen that the upper regions of the side walls 6 of the inner container 2 are provided with an access opening 13 arranged adjacent to the inner periphery of the outer sleeve 3. The access openings 13 may serve as gripping sections to remove the inner container 2 from the outer sleeve 3. The provision of access openings 13 on both sides of the inner container 2 has the advantage that it does not matter in which orientation the inner container 2 is inserted into the outer sleeve 3, but the user can grip and withdraw the inner container 2 from the outer sleeve 3 in both possible directions.

Furthermore, the location of an access opening 13 adjacent the dispensing mouth 9 may also facilitate the gripping of a leading end of a new stack of napkins, and the introduction of said leading end through the dispensing mouth 9.

A further reason for providing slots or openings in the side walls 6 could be to observe the filling level of napkins inside the inner container 2 (not shown).

A releasable locking means for releasably locking the inner container 2 to the outer sleeve 3 is arranged at the bottom of the dispenser 1. FIGS. 1 to 4 illustrate one type of locking means that may advantageously be used in the dispenser of the present application. The releasable locking means is centrally arranged along the length between the bottom wall 5 of the inner container 2 and the bottom wall of the outer sleeve 3. A resilient tongue 15 is arranged in the bottom wall 5 of the inner container 2. Said resilient tongue 15 snap-fits into an opening 16 arranged through the corresponding bottom wall of the outer sleeve 3.

When the inner container 2 is locked to the outer sleeve 3, the resilient tongue 15 is accessible from the bottom side of the dispenser 1, enabling release of the tongue 15 from the opening 16 by manually pressing the tongue 15 out of the opening 16 from the bottom side of the dispenser 1.

In the embodiments shown, the outer sleeve 3 can be made from a metal material, for example from aluminum or stainless steel, which is extruded and cut into the respective form. However, other materials can also be used which are rigid enough to perform the function of receiving the inner container 2, in particular metal band materials, extruded plastic materials, wooden materials and laminates thereof.

The inner container 2 can be made from a wooden material, a plastic material or laminates thereof. As to the plastic material, a transparent or see-through plastic material might be of particular benefit in some applications. Naturally, the inner container 2 can be made from the same material as the outer sleeve 3, depending on specific design considerations.

The bottom surface of the outer sleeve 3 is furnished with one or more supporting means 20, such as e.g. rubber feet, or feet lined with an upholstered material to prevent scratching of any surface onto which the dispenser is placed.

In the following, the process of filling the dispenser 1 with napkins will be described. In particular, napkins are provided in the form of a stack, which contains separate napkins that are interfolded such that, when removing the top napkin, the subsequent napkin will automatically present its leading end. The napkins used with the dispenser 1 may have any suitable size which fits into the interior volume defined by the inner container 2.

The stack of interfolded napkins 5 is inserted into the inner container 2, while pushing the supportive surface 8 towards its lowest position adjacent the bottom wall 5. The stack of napkins is placed onto the supportive surface or platform 8, such that the tabs 100 extending from the upper edges of opposing side walls 6 abut the upper side of the uppermost panel of a stack of napkins.

According to embodiments, the tabs 100 are pivotable about the hinge 101, such that the introduction of napkins past the tabs 100 and into the inner container 2 might be facilitated. The tabs 100 restrict the upward movement of the supporting surface 8, and ensure that the uppermost napkin is kept in position when it is withdrawn from the dispenser 1. The tabs 100 will also prevent that multiple napkins are unintentionally withdrawn at the same time.

From the Figures it is seen that the top panel of the stack will always be located at the position of the tabs 100, such that the vertical distance between the top panel of the stack and the dispensing mouth 9 will always be constant. This means that a specific length of the leading end of the uppermost sheet will extend from the top panel and out via the dispensing mouth 9 to be presented to a user. By selection of the vertical distance between the tabs 100 and the dispensing mouth 9, a suitable length for upright presentation of the end of the sheet may be achieved.

In more detail, the loading of the stack of napkins is facilitated in that the inner container 2 is provided with pivotable tabs 100. When a stack of napkins is loaded into a container 2 provided with pivotable tabs 100, said pivotable tabs 100 are placed in a refill position or loading orientation, wherein the tabs 100 are directed away from the dispensing opening 7 (see FIG. 3*b*). Thereafter, the supportive surface 8 is pushed towards its lowest position adjacent the bottom wall 5, while the stack of napkins is placed on top of the supportive surface 8. The stack is manually held back while the pivotable tabs 100 are repositioned or they resiliently spring into the holding position, in which the tabs 100 abut the upper side of the uppermost panel of a stack of napkins (see FIG. 3*a*). The tabs 100 are limited to a stack holding orientation by the one or more stop surfaces 103, 110 to retain the top of the stack spaced from the dispensing mouth 9 in the vertical direction.

As napkins are dispensed, the height of the stack contained in the dispenser 1 will diminish, allowing the supporting surface 8 to move vertically upwards. When all napkins have been withdrawn from the dispenser 1, the tabs 100 will abut the supporting surface 8.

After the stack of napkins has been loaded into the inner container 2, the inner container 2 is inserted into the outer sleeve 3 along the insertion direction D extending in parallel with the dispensing mouth 9, such that when inserted in the outer sleeve 3, the dispensing opening 7 of the container 2 is aligned with the dispensing mouth 9 of the outer sleeve 3.

As described in the above, the inner container 2 may be inserted into the outer sleeve 3, while a leading end of a stack of napkins contained in the inner container 2 is allowed to protrude vertically from the dispensing opening 7 of the inner container 2. Hence, the protruding leading end of the stack is introduced into the dispensing mouth 9 via the open end thereof as the inner container 2 is introduced into the outer sleeve 2 via the open end 10 thereof, enabling easy set-up of the dispenser.

The insertion of the inner container 2 into the outer sleeve 3 is facilitated by means of the access openings 13 provided on the side walls 6 of the inner container 2, in that said access openings 13 enable the user to grip the inner container 2 using the access openings 13 and insert said container into the outer sleeve 3 from any direction.

Moreover, the access openings 13 are useful in that they may facilitate gripping of the leading end of a new stack of napkins, contained in the inner container 2, before introduction of the inner container 2 into the outer sleeve 3.

Also, once the inner container 2 is inserted into the outer sleeve 3, the access openings 13 enable the user to grip a leading end of a new stack of napkins and introduce said leading end through the dispensing mouth 9. Such introduction is facilitated by means of the access openings 13 on the side walls 6, through which the user may insert two or more fingers to position the leading end of the stack of napkins into the dispensing mouth 9. Manipulation of the leading end of the stack via the access openings 13 may hence provide an alternative way of setting the dispenser in a ready-to use condition. In particular, this way may be preferred in cases when the stack contained in the dispenser is interrupted, such that a new napkin does not automatically follow a withdrawn napkin.

In the illustrated embodiment, the access openings 13 include cut-outs in the side walls of the inner container.

The dispenser further includes a releasable locking means for releasably locking the inner container 2 inside the outer sleeve 3. In the illustrated embodiment, the releasable locking means are centrally arranged between the bottom wall 5 of the inner container 2. The bottom wall of the outer sleeve 3 will automatically enter into a locking position when the inner container 2 is inserted into the outer sleeve 3. The resilient tongue 15 arranged in the bottom wall 5 of the inner container 2 will snap-fit into the opening 16 arranged through the corresponding bottom wall of the outer sleeve 3.

Removal of the inner container 2 from the outer sleeve 3 is enabled by manually pressing the tongue 15 out of the opening 16 from the bottom side of the dispenser 1, and simultaneously gripping the inner container 2, for example by means of the access openings 13 provided on either side wall 6 of the container 2, and pulling the inner container 2 out of the outer sleeve 3 along the insertion direction D.

The manner of loading a stack of napkins or other sheet products, for example interfolded, into a dispenser 1 will be described in yet further detail with reference to FIGS. 6 and 7.

FIG. 7 shows a housing in the form of an inner container 2 according to the dispenser 1 of the preceding figures. It is envisaged, however, that other dispenser configurations could be provided including an alternative form of housing 2 having one or more sidewalls 6 defining an interior volume for receiving and containing a stack of sheet products.

In FIG. 7, there is shown a stack 120 partially inserted into the housing 2. During insertion, a rear of the stack 120 is brought into engagement with each stack engaging part 100 of one or more holdback members 11 when the stack engaging part 100 are in the stack engaging orientation. Passage of the stack 120 in an insertion direction toward the bottom of the interior volume defined by the housing 2 causes the stack engaging parts 100 to turn or rotate about the hinge 101 into a stack loading orientation. In the stack loading orientation, the stack engaging parts 100 are disposed more parallel in order to provide clearance for passage of the stack 120 during loading. In FIG. 7, the stack engaging parts 100 are not exactly parallel, but are significantly more parallel to the sidewall 6 than a perpendicular orientation thereof. The stack engaging parts 100 may be able to turn about the hinges 101 from the position shown in FIG. 7 to a completely parallel orientation as allowed by the limit of a downward orientation of the stack engaging parts 100 defined by stop surfaces of the ribs 107, or other stop surfaces that define a maximum extent of turning about the hinge 101 in the direction away from the dispensing mouth 9.

The stack 120 will be accommodated in the interior volume defined by the housing 2 such that the top of the stack 120 will clear the stack engaging parts 100 to allow the stack engaging parts 100 to be pivoted about the hinges 101 to return to a stack engaging orientation as shown in FIG. 6. Movement of the stack engaging parts 100 about the hinge 101 from the loading orientation shown in FIG. 7 to the stack engaging orientation shown in FIG. 6 may be performed manually, but can be performed by action of the resilient nature of the material forming the holdback members 11 or by other automatic spring means. Referring to FIG. 6, the stack engaging orientation holds the stack 120 at a vertical space from the dispensing mouth 9 so that the top of the stack 120 is not disposed directly against an inside surface of a dispensing face defining the dispensing mouth 9 and so that a foremost sheet product in the stack 120 has some vertical space in which to extend before passing through the dispensing mouth 9. This provides for improved dispensing movement, avoidance of bunching of napkins and increased reliability of single sheet product dispensing. In FIG. 6, the stack engaging part 100 of each holdback member 11 is not exactly perpendicularly oriented relative to the sidewalls 6 of the housing 2, but still defines an orientation that is more perpendicular than it is parallel and obstructs the top of the stack 120 from passage toward the dispensing mouth 9 in order to be assured of the spacing therefrom.

The stack 120 can be biased toward the dispensing mouth 9, and this may be implemented by way of a platform 8 that is spring biased toward the dispensing mouth 9 as described above. Thus, during loading of the stack 120, the platform 8 must be moved away from the dispensing mouth 9 in a direction away from the dispensing mouth 9 toward a bottom of the housing 2 against the bias of the spring. During dispensing use, the platform 8 and the stack 120 is biased toward the dispensing mouth 9 by action of the spring, but the space between an inside most part of the dispensing mouth 9 and the top of the stack 120 is maintained by the level of the stack engaging parts 100 of the holdback members 11 when they are disposed in the stack engaging orientation. Further, the one or more stop surfaces 103, 110 allow the stack engaging parts 100 to rotate in a direction toward the dispensing mouth 9 until one or more abutment surfaces are brought into contact with the one or more stop surfaces 103, 110 at which point a limit or maximum amount of turning about the hinge 101 in a direction toward the dispensing mouth 9 is reached. In this limit orientation, the stack engaging parts 100 remain substantially perpendicularly extending relative to the respective sidewalls 6 so as to engage a top of the stack 120 and maintain a vertical spacing of the top of the stack 120 from the dispensing mouth 9. The one or more stop surfaces 103 allow the hinge 101 to be made particularly flexible, without compromising the ability of the stack engaging parts 100 to maintain the top of the stack 120 spaced from the dispensing mouth 9 even under the bias of the spring 14 urging the stack 120 toward the dispensing mouth 9.

The above specific embodiment has been described with respect to one type of dispenser, namely a tabletop dispenser. However, the holdback members 11 described herein including the stop surfaces 11, 111 and/or the flexible hinge 101 could be implanted in numerous other dispenser configurations. For example, referring to the in-counter dispenser of FIGS. 1 and 2 of WO2014037041, the tabs 15, 16 shown in these prior art figures could be replaced with members having flexible hinges as described herein and/or having stop surfaces as described herein. It is also envisaged that holdback members and stop surfaces as described herein could be implemented with countertop dispensers, for example as shown in FIGS. 1 and 2 of WO2013064165. The holdback members described herein would also have utility in other types of tabletop dispenser, such as that disclosed in FIGS. 6 and 7 of WO2013064165. The present inventors also anticipate advantageous use of the holdback members and optionally also the stop surfaces described herein in a stand or gravity feed type dispenser, such as disclosed in WO/2005/034702. Thus, the turning direction may be vertically upwards or downwards depending upon the dispenser design as the stack engaging part moves from the engaging orientation to the stack loading orientation. Accordingly, the holdback members and optionally also the stop surfaces described herein are useful in association with many types of dispenser, particularly in-counter, on-counter, tabletop, etc.

Although the present disclosure has been described with reference to various embodiments, those skilled in the art will recognize that changes may be made without departing from the scope of the disclosure. It is intended that the detailed description be regarded as illustrative and that the appended claims including all the equivalents are intended to define the scope of the disclosure. In particular, the disclosure has been described with reference to embodiments being dispensers of the table-top type, but may equally well be utilized in other types of dispensers such as in-counter dispensers.

The invention claimed is:

1. A dispenser, comprising:

a housing defining at least partly an interior volume for holding a stack of sheet products;

a dispensing mouth through which sheet products are able to be dispensed from the dispenser in a dispensing direction; and one or more stack holdback members, wherein the stack holdback members each include a stack engaging part and a flexible hinge, wherein the stack engaging part of each of the holdback members is able to turn about the flexible hinge from a stack engaging orientation to a stack loading orientation, wherein, when the stack engaging parts of the holdback members are in the stack engaging orientation, the stack engaging parts of the holdback members are arranged for engaging the front of the stack to space the front of the stack rearwardly from the dispensing mouth, and, when the stack engaging parts of the holdback members are in the stack loading orientation, the stack engaging parts are arranged for providing clearance as compared to when the stack engaging parts are in the stack engaging orientation, the clearance allowing a stack to pass into the interior volume defined by the housing for loading the dispenser, wherein the flexible hinge allows turning about the flexible hinge as a result of relatively increased flexibility compared to neighboring regions of material along a hinge axis or line, wherein the stack engaging part and the flexible hinge of each stack holdback member are integral components, and wherein the one or more holdback members extends only part way across the interior volume toward an opposed sidewall of the housing, when the stack engaging parts of the holdback members are in the stack engaging orientation, such that no portion of the one or more holdback members is within the dispensing mouth.

2. The dispenser of claim 1, wherein the stack engaging part of each of the holdback members is able to turn about the flexible hinge in a first direction from the stack engaging orientation to the stack loading orientation, wherein the dispenser comprises one or more stop surfaces for limiting turning of each stack engaging part of the holdback members about the flexible hinge in a second direction opposed to the first direction to a limit orientation, and wherein, when the stack engaging parts of the stack holdback members are in the limit orientation, the stack engaging parts are arranged to engage the front of the stack to hold the front of the stack spaced rearwardly from the dispensing mouth.

3. The dispenser of claim 1, wherein the flexible hinge of each of the holdback members is a living hinge.

4. The dispenser of claim 1, wherein the flexible hinges each connect a housing part and a stack engaging part of the holdback members, wherein the stack engaging part is able to turn relative to the housing part about the flexible hinge, and the flexible hinge comprises one or more gaps located along the hinge line at which the stack engaging part and the housing part are unconnected.

5. The dispenser of claim 1, wherein the holdback members each include a bridge portion for spacing the flexible hinge interiorly from a sidewall of the housing defining at least part of the interior volume in a direction normal to the sidewall.

6. The dispenser of claim 2, wherein the holdback members each include one or more abutment surfaces and are configured so that as the stack engaging part turns about the flexible hinge in the second direction, the abutment surfaces are caused to contact the stop surfaces to prevent further rotation of the stack engaging part in the second direction.

7. The dispenser of claim 2, wherein the one or more stop surfaces are formed by one or more overhangs for contacting the stack engaging part of each of the holdback members.

8. The dispenser of claim 7, wherein the overhangs each define a curved surface or angled surface to smoothen an interface with the stack during loading.

9. The dispenser of claim 1, wherein the stack engaging part of each of the holdback members includes a flat surface for interfacing with the top of the stack in the stack engaging orientation, wherein the flat surface extends perpendicularly or substantially perpendicularly to a sidewall of the housing at least partly defining the interior volume when the stack engaging part is in the stack engaging orientation.

10. The dispenser of claim 1, wherein the stack engaging part of each of the holdback members is arranged to engage in a margin area of the front of the stack in the stack engaging orientation.

11. The dispenser of claim 1, further comprising a removable or openable cover defining the dispensing mouth, wherein the cover is able to be removed or opened in order to reveal an entrance to the interior volume defined at least partly by the housing to provide access to the interior volume for loading, and the holdback members are able to engage the stack and hold the stack within the interior volume when the cover is removed or opened and when the holdback members are in the stack engaging orientation, and wherein when the cover is replaced or closed, the entrance is partly covered so that sheet products are able to be removed from the stack through the dispensing mouth.

12. The dispenser of claim 1, further comprising a platform arranged in the housing that is moveable in a forward and rearward direction, wherein the platform is arranged to provide a stack support surface upon which a rear of the stack is supported, and biasing means is arranged to act on the platform to bias it toward the dispensing mouth.

13. The dispenser of claim 1, wherein the housing comprises a rear wall and a front wall and one or more sidewalls extending normally relative to the front and rear walls, and wherein an interior surface of each of the walls together defines the interior volume.

14. The dispenser of claim 1, wherein the stack engaging parts of the one or more holdback members are located at a front end of the housing, adjacent the dispensing mouth.

15. The dispenser of claim 1, wherein the dispenser comprises at least two holdback members, wherein the housing defines a generally rectangular or square cross-section at a front end of the housing adjacent the dispensing mouth, wherein the cross-section is taken perpendicular to an axis passing centrally from a rear of the dispenser, through a centre of the interior volume and centrally through the dispensing mouth, and the holdback members are located on opposed sides of the rectangular or square cross-section and centrally located along the respective opposed side.

16. The dispenser of claim 1, wherein a rear facing surface of each stack engaging part of the one or more holdback members for engaging a front of the stack are located in the stack engaging orientation at least 0.5 cm from the dispensing mouth, so as to space the front of the stack by at least 0.5 cm from the dispensing mouth.

17. The dispenser of claim 1, wherein the housing includes a front wall, a rear wall and one or more sidewalls extending normally between the front and rear walls to define the interior volume, and wherein the dispensing mouth is included in the front wall of the dispenser housing and the one or more holdback members serve to hold a front of the stack back from an interior surface of the front wall having the dispensing mouth extending through it.

18. The dispenser of claim 1, wherein the stack engaging part of each of the one or more holdback member extends freely, in a cantilevered manner, from a sidewall of the housing.

19. The dispenser of claim 2, wherein the one or more stop surfaces project from a sidewall of the housing.

20. The dispenser of claim 19, wherein the stack engaging part of each of the one or more holdback members project from a sidewall of the housing, and wherein the projection of the stop surfaces is less than the projection of the stack engaging part.

21. The dispenser of claim 2, wherein there are at least two separated stop surfaces associated with each holdback member, arranged at opposed ends of the flexible hinge relative to the hinge axis of the flexible hinge.

22. The dispenser of claim 2, wherein each of the one or more stop surfaces are positioned in front of the stack engaging part of the one or more holdback members and in overlapping relation when viewed from the dispensing mouth.

23. The dispenser of claim 2, wherein the one or more stop surfaces are positioned to limit turning of the stack engaging parts about the flexible hinge to a position extending more perpendicularly than parallel relative to one or more sidewalls of the housing from which the stack engaging parts project.

24. The dispenser of claim 1, wherein the flexible hinge and the stack engaging parts of each holdback member are integrally injection molded components.

25. A method of refilling the dispenser of claim 1 with a new stack of napkins, comprising:

turning the stack engaging part of each of the one or more holdback members about the flexible hinge from the stack engaging orientation to the stack loading orientation to provide clearance, passing the stack through the holdback members into the interior volume from outside of the dispenser as allowed by the clearance provided, and allowing or causing the stack engaging part of each holdback member to return to the stack engaging orientation so that the stack is retained in a position spaced from the dispensing mouth in use by the stack engaging parts of the holdback members.

26. The dispenser of claim 2, wherein the one or more stop surfaces are fixed and an associated stack engaging part moves relative thereto when turning about the flexible hinge to bring the stop surfaces into action to limit further movement of the associated stack engaging part about the flexible hinge.

* * * * *